US008844774B2

(12) United States Patent
Leys et al.

(10) Patent No.: US 8,844,774 B2
(45) Date of Patent: Sep. 30, 2014

(54) PRESSURIZED SYSTEM FOR DISPENSING FLUIDS

(75) Inventors: John A. Leys, Chaska, MN (US); John M. Hennen, Carver, MN (US); Michael L. Johnson, Minneapolis, MN (US)

(73) Assignee: Entegris, Inc., Billerica, MA (US)

( * ) Notice: Subject to any disclaimer, the term of this patent is extended or adjusted under 35 U.S.C. 154(b) by 1233 days.

(21) Appl. No.: 12/200,590

(22) Filed: Aug. 28, 2008

(65) Prior Publication Data

US 2009/0057347 A1 Mar. 5, 2009

Related U.S. Application Data

(60) Provisional application No. 60/968,510, filed on Aug. 28, 2007, provisional application No. 60/992,292, filed on Dec. 4, 2007, provisional application No. 61/025,547, filed on Feb. 1, 2008, provisional application No. 61/068,030, filed on Mar. 4, 2008.

(51) Int. Cl.
*B65D 83/00* (2006.01)
*B67D 7/60* (2010.01)
*B67D 1/08* (2006.01)

(52) U.S. Cl.
CPC .... *B65D 83/0055* (2013.01); *B67D 2001/0828* (2013.01)
USPC ..... 222/400.7; 222/105; 222/386.5

(58) Field of Classification Search
USPC ..... 222/386.5, 105, 95, 389, 396, 397, 222/400.7
See application file for complete search history.

(56) References Cited

U.S. PATENT DOCUMENTS

| | | | |
|---|---|---|---|
| 2,564,163 | A | 8/1951 | Leperre |
| 2,762,534 | A | 9/1956 | Kish |
| 3,223,289 | A | 12/1965 | Bouet |
| 3,240,394 | A | 3/1966 | Modderno |

(Continued)

FOREIGN PATENT DOCUMENTS

| | | |
|---|---|---|
| EP | 0 380 348 | 8/1966 |
| EP | 0 432 343 | 6/1991 |

(Continued)

OTHER PUBLICATIONS

The Patent Office of the State Intellectual Property Office of the People's Republic of China, The First Office Action, CN Application No. 200880114604.1, mailed May 3, 2012 (6 pages, including translation).

(Continued)

*Primary Examiner* — Kevin P Shaver
*Assistant Examiner* — Patrick M Buechner
(74) *Attorney, Agent, or Firm* — Christensen Fonder P.A.

(57) ABSTRACT

A bag-in-bag-in-bottle assembly formed by a flexible dispensing container with a dispensing fitment. The dispensing container is positioned adjacent or sandwiched between one or more flexible pressurization containers having a separate inlet/outlet path through a second fitment. The bag-in-bag assembly can then be placed in a containment vessel with the fitments mounted such that it is accessible on the vessel. A liquid can be extracted from the dispensing container by introducing a fluid into the pressurization container(s) with enough pressure to force the liquid out through the dispensing fitment. A contoured dispensing head may be coupled to the bag-in-bag-in-bottle assembly using a earn actuation arrangement for simultaneously locking the pressurization, vent and fluid extraction couplings.

25 Claims, 20 Drawing Sheets

(56) References Cited

U.S. PATENT DOCUMENTS

| | | | | |
|---|---|---|---|---|
| 3,463,536 | A | 8/1969 | Updegraff et al. | |
| 3,467,283 | A | 9/1969 | Kinnavy | |
| 3,662,929 | A | 5/1972 | Sims | |
| 3,767,078 | A | 10/1973 | Gortz et al. | |
| 3,883,046 | A | 5/1975 | Thompson et al. | |
| 4,039,103 | A | 8/1977 | Juillet | |
| 4,098,434 | A | 7/1978 | Uhlig | |
| 4,138,036 | A | 2/1979 | Bond | |
| 4,165,023 | A | 8/1979 | Schmit | |
| 4,203,440 | A * | 5/1980 | Theeuwes | 604/892.1 |
| 4,267,827 | A | 5/1981 | Rauscher et al. | |
| 4,286,636 | A | 9/1981 | Credle | |
| 4,377,246 | A | 3/1983 | McMillin et al. | |
| 4,445,539 | A | 5/1984 | Credle | |
| 4,454,945 | A | 6/1984 | Jabarin et al. | |
| 4,491,247 | A | 1/1985 | Nitchman et al. | |
| 4,601,409 | A | 7/1986 | DiRegolo | |
| 4,699,298 | A | 10/1987 | Grant et al. | |
| 4,793,491 | A | 12/1988 | Wolf et al. | |
| 4,872,558 | A | 10/1989 | Pharo | |
| 4,909,403 | A | 3/1990 | Reyes | |
| 4,921,135 | A | 5/1990 | Pleet | |
| 4,951,512 | A | 8/1990 | Mazza et al. | |
| 4,984,717 | A | 1/1991 | Burton | |
| 5,031,801 | A | 7/1991 | Osgar et al. | |
| 5,069,363 | A | 12/1991 | Daimler | |
| 5,102,010 | A | 4/1992 | Osgar et al. | |
| 5,108,015 | A | 4/1992 | Rauworth et al. | |
| 5,255,492 | A | 10/1993 | Larson | |
| 5,335,821 | A | 8/1994 | Osgar | |
| 5,377,876 | A | 1/1995 | Smernoff | |
| 5,435,460 | A | 7/1995 | Osgar | |
| 5,526,956 | A | 6/1996 | Osgar | |
| 5,562,227 | A | 10/1996 | Takezawa et al. | |
| 5,582,254 | A * | 12/1996 | Pistek | 169/73 |
| 5,597,085 | A | 1/1997 | Rauworth et al. | |
| 5,641,006 | A | 6/1997 | Autrey et al. | |
| 5,875,921 | A | 3/1999 | Osgar et al. | |
| 5,957,328 | A | 9/1999 | Osgar | |
| 6,015,068 | A | 1/2000 | Osgar et al. | |
| 6,158,853 | A | 12/2000 | Olsen et al. | |
| 6,206,240 | B1 | 3/2001 | Osgar et al. | |
| 6,345,739 | B1 | 2/2002 | Mekata | |
| 6,698,619 | B2 | 3/2004 | Wertenberger | |
| 6,749,808 | B1 | 6/2004 | Huynen et al. | |
| 6,879,876 | B2 | 4/2005 | O'Dougherty et al. | |
| 6,942,123 | B2 | 9/2005 | Wertenberger | |
| 7,025,234 | B2 | 4/2006 | Priebe et al. | |
| 7,156,132 | B2 | 1/2007 | O'Dougherty et al. | |
| 7,172,096 | B2 | 2/2007 | O'Dougherty | |
| 7,188,644 | B2 | 3/2007 | Kelly et al. | |
| 7,316,329 | B2 | 1/2008 | Wertenberger | |
| 7,370,791 | B2 | 5/2008 | O'Dougherty et al. | |
| 7,896,199 | B2 | 3/2011 | Kaczmarek | |
| 2003/0075566 | A1 * | 4/2003 | Priebe et al. | 222/318 |
| 2005/0087237 | A1 | 4/2005 | O'Dougherty et al. | |
| 2005/0103802 | A1 | 5/2005 | Alberg | |
| 2005/0177274 | A1 | 8/2005 | O'Dougherty et al. | |
| 2005/0224523 | A1 | 10/2005 | O'Dougherty et al. | |
| 2009/0212071 | A1 | 8/2009 | Tom et al. | |

FOREIGN PATENT DOCUMENTS

| | | | |
|---|---|---|---|
| EP | 0 432 343 | A1 | 6/1991 |
| JP | 59113398 | | 6/1984 |
| JP | 59187571 | | 10/1984 |
| JP | 2-152571 | A | 6/1990 |
| JP | 3030927 | | 2/1991 |
| JP | 6013659 | | 1/1994 |
| JP | 09-183467 | A | 7/1997 |
| JP | 10-512526 | A | 12/1998 |
| JP | 2001522338 | | 11/2001 |
| TW | M 316224 | | 8/2007 |
| WO | WO 96/22226 | A1 | 7/1996 |
| WO | WO 98/40703 | | 9/1998 |
| WO | WO 2006/133026 | | 12/2006 |
| WO | WO 2006/133026 | A2 | 12/2006 |

OTHER PUBLICATIONS

Written Opinion and Search Report, SG Application No. 201001170-8, mailed Apr. 5, 2012 (15 pages).

* cited by examiner

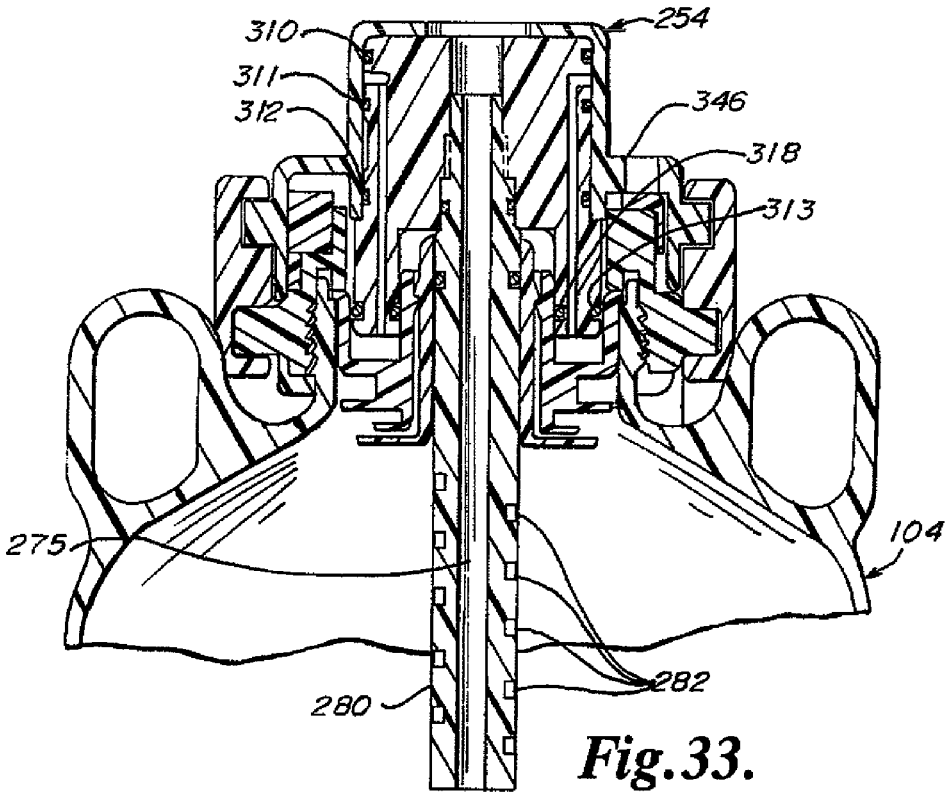
Fig.33.
Fig.37A.
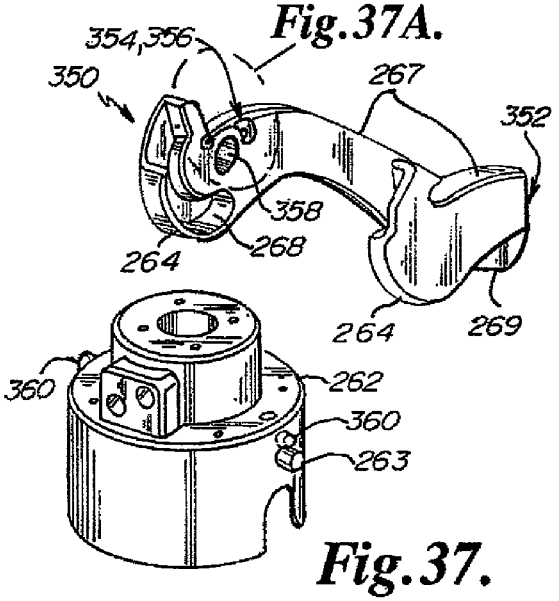
Fig.37.

PRESSURIZED SYSTEM FOR DISPENSING FLUIDS

RELATED APPLICATIONS

The present application claims the benefit of U.S. Provisional Application Nos. 60/968,510 filed Aug. 28, 2007, 60/992,292 filed Dec. 4, 2007, 61/025,547 filed Feb. 1, 2008, and 61/068,030 filed Mar. 4, 2008, all of which are hereby incorporated by reference herein in their entirety.

FIELD OF THE INVENTION

The present invention is generally directed to the field of flexible plastic materials for containment of liquids. More specifically, the present invention is directed to a method, apparatus, dispense systems, and components for dispensing a dispense fluid by providing pressurization fluid.

BACKGROUND OF THE INVENTION

The concept of collapsible containers held in rigid containers has been practiced for many years. These concepts can range from the relatively simple such as, a cardboard coffee tote with a flexible plastic bladder, to more complex systems for handling hazardous or highly pure chemicals in specialized double-wall sealed containers. Regardless of design, the general principle involves a flexible container in the shape of a pouch or bag that collapses as the contents of the bag or pouch are extracted or dispensed. The flexible container is contained in a rigid outer container such as a box, drum, or bottle used to support and protect the flexible pouch or bag and to provide containment for a pressurization fluid used to collapse the bag or pouch.

A variety of improved collapsible container designs have been suggested and patented. Examples of collapsible bag-in-container designs include U.S. Pat. No. 3,223,289 to Bouet, U.S. Pat. No. 5,377,876 to Smernoff, and U.S. Pat. No. 5,562,227 to Takezawa et al., each of which is hereby incorporated by reference herein except for explicit definitions contained therein. A variety of bag-in-bottle designs have also been contemplated in the design of chemical containers. Representative examples include U.S. Pat. No. 4,793,491 to Wolf et al., U.S. Pat. No. 5,102,010 to Osgar et al., U.S. Pat. No. 5,597,085 to Rauworth et al., and U.S. Pat. No. 6,158,853 to Olsen et al., each of which is hereby incorporated by reference herein except for explicit definitions contained therein.

Additionally, a variety of alternative designs utilizing one or more methods of extracting the contents of the flexible bag from the container assembly have been utilized. Examples of these designs include U.S. Pat. No. 3,467,283 to Kinnavy, U.S. Pat. No. 3,767,078 to Gortz et al., U.S. Pat. No. 4,445,539 to Credle, U.S. Pat. No. 4,925,138 to Rawlins, U.S. Pat. No. 6,206,240 to Osgar et al., U.S. Pat. No. 6,345,739 to Mekata, U.S. Pat. No. 6,698,619 to Wertenberger, and U.S. Pat. No. 6,942,123 to Wertenberger, each of which is hereby incorporated by reference herein except for explicit definitions contained therein. These configurations have not provided optimal performance and cleanliness particularly for dispensing highly pure fluids in the semiconductor processing industry, for example, photoresist. Typically, the pressurization fluid is provided to the space between an inner dispense bag and a rigid outer container. In such an arrangement, the inner bag may collapse non-uniformly causing an excess amount of the fluid to remain in the inner bag, preventing the complete dispensing of the fluid. The wasted fluid also exacerbates recycling and disposal issues associated with the inner bag.

Bag-in-bottle dispensers are used extensively in the photolithography industry for dispensing photoresist. It has been discovered that where the pressurization fluid is a gas (e.g., nitrogen), the gas can permeate the walls of the flexible containers comprised of materials (e.g. fluoropolymers) that are compatible with dispense photoresist. Accordingly, in systems where the pressurization fluid is in direct contact with the flexible container holding the dispense liquid, the pressurization gas can diffuse into the flexible container, thereby causing micro-bubbles to form within the contained dispense fluid and contaminating the dispense fluid.

Fluoropolymer-based materials are difficult to bond with materials that are highly gas impermeable (e.g., polyethylene), due in part to substantially different melt temperatures of the respective materials. Recent efforts addressing the gas diffusion issue have included abandonment of fluoropolymer-based materials and providing a single flexible bag with a dual wall, wherein the inner wall is a clean polyethylene and the outer wall is a polyethylene/nylon laminate that resists gas permeation. The polyethylene-based materials were chosen for compatibility in the bonding process of the inner wall to the outer wall. It was found, however, that the resistance of the inner wall to photoresist was inadequate.

There remains a need to identify improved designs that have a minimum of cost and contamination while maximizing device integrity, flexibility of use, and ease of predictably extracting the contents of the container.

SUMMARY OF THE INVENTION

Various aspects of the invention include inner and outer flexible containers disposed in a containment vessel for dispensing fluid from the container more efficiently and completely than in prior art devices. Other embodiments may include a cap assembly that cooperates with a dispense head for pressurization of the outer flexible container for extraction of the fluid from the inner flexible container. The cap may be configured with a key code device coded to identify the type of fluid contained in the containment vessel and cooperates only with dispense heads that are configured for compatible mating with the key code device. The dispense head may be configured with cams that engage with the cap for quick and easy engagement and release. The cams may be actuated by a handle that is contoured so that, when in the fully engaged position, no portion of the handle extends beyond the footprint of the containment vessel. The dispense head may also include a stem or dip tube that extends from the cap into the inner flexible container and having an inlet on the distal end through which the fluid is extracted. The dip tube may include a passage or groove formed on the exterior, providing a way for pockets of fluid otherwise trapped against the dip tube to drain downward for extraction through the dip tube inlet.

In one embodiment, an inner flexible container for containing the dispense fluid may comprise a member of a chemical resistant polymer, such as a fluoropolymer. For example, pin-hole free perfluoroalkoxy (PFA) material is desirable for containing chemicals such as photoresist due to inert molecular properties which prevent contamination or leakage of the fluid. The inner flexible container can be formed by sealing a dispensing fitment in a hole in the center of a rectangular, octagon, or other custom shaped sheet or member of PFA material. The PFA member may be folded in half such that the two halves can be sealed together at the edges of the open sides, forming the inner flexible container with the dispensing fitment located at the top of the container. The outer flexible container may comprise a separate outer fitment sealed to a hole proximate the center of two sheets (inner and outer members) of polyethylene (PE) or other flexible non-permeable material The outside perimeter of the inner and outer members of the outer flexible container may be of greater dimension than the sheets of the inner flexible container, but of a similar shape. The perimeter of the inner and outer members can be sealed to form the outer flexible container. The fitments may be designed such that the inner fitment of the inner flexible container can pass through a central passageway of the outer fitment. The outer fitment enables a pressurized gas (e.g., nitrogen) or other fluid to be injected into the outer flexible container. The outer flexible container can be folded in half to create a saddle-like shape about the inner flexible container when the two fitments are joined together.

The assembled inner and outer flexible containers (also referred to herein as a "bag-in-bag assembly") may be fused together by joining the inner flexible container with the saddle-shaped outer flexible container. Where different materials are utilized for the inner and outer flexible containers (e.g. PFA and PE), the difference in melt temperatures may preclude simply welding them together by melting. However, the inner and outer flexible containers can be joined by punching a plurality of through holes at select points about the perimeter of the inner flexible container and connecting the two saddle-like portions of the outer flexible container to each other through the plurality of holes. The resulting configuration of this embodiment is of central dispensing container sandwiched between two portions of a pressurization container. The two saddle-like portions of the outer flexible container may be in fluid communication with each other. A dispense head is sealingly attachable to the fitments for providing an ingress/egress access for the dispense fluid, an inlet port for the pressurization fluid and venting for gasses trapped between the container.

The bag-in-bag assembly can then be placed into the containment vessel to facilitate storage, transport, filling, and dispensing of the contents. The containment vessel restricts outward movement of the outer flexible (pressurization) container so that, when pressurized, the outer flexible container grows inward against the inner flexible (dispensing) container, forcing the liquid within the inner flexible container to egress through the inner fitment.

The fitments of the inner dispense container and the outer pressurization container may be configured to cooperate in a concentric arrangement. Moreover, a venting path can be provided to the space intermediate the flexible containers and the containment vessel through the fitments.

An advantage of embodiment of the invention described above is that the pressurization fluid does not directly contact the dispensing container. Certain embodiments of the invention provide a barrier of material that is highly gas impermeable between the inner flexible container and the pressurization fluid. Experiments have demonstrated that the provision of the highly gas impermeable barrier significantly reduces the formation of microbubbles in the dispense liquid.

A further advantage of certain embodiments of the invention is that the inner dispensing container may be constricted in a substantially uniform and flat manner, enabling thorough dispensing of the contents. A further feature and advantage of certain embodiments is that the containment vessel does not need to be sealed although in some embodiments a sealed containment vessel may be to provide another containment layer for the dispense fluid. Moreover, the seal between the inner and outer fitments and the containment vessel and the seal between the pressurization container and the containment vessel can be less critical in some embodiments.

In some embodiments, the inner fluid dispense container may be sandwiched between two separate bags, each bag having a separate fitment for attachment to a pressurization fluid source.

In some embodiments, the dispense container may be placed adjacent a pressurization bag. By injecting fluid (e.g., nitrogen) to the pressurization bag, the dispense bag is compressed between the pressurization bag and the containment vessel. This can also provide the feature and advantage of a uniform collapse of the dispense bag, thorough dispensing, and isolation of the pressurization fluid from the dispense bag.

In certain embodiments, the inner flexible container may be placed inside an outer flexible container. The pressurization may be applied to the interior of the outer flexible container whereby the pressurization fluid acts directly on the outer surface of the inner flexible container.

Alternatively, the pressurization fluid may be applied between the exterior of the outer flexible container and the containment vessel to apply the extraction force. The outer flexible container then acts as a barrier that is non-permeable to gasses, thus providing the protection to the inner container.

In a further variation, three concentrically arranged flexible containers may be installed in a containment vessel where the inner flexible dispense container is contained in a second flexible container and the second flexible container is contained within a third flexible container. All three flexible containers are contained in the containment vessel. The pressurization fluid may be injected into the space between the second and third bag thereby isolating the pressurization fluid from contact with the inner dispense bag as well as the containment vessel.

In a further embodiment, a plurality of pressurization bags may be placed adjacent the dispense bag. The pressurization bags may be pressurized in stages to facilitate complete dispensing. For example, a bag or bags at the lower inside of the containment vessel may be pressurized before an adjacent bag thereabove. Such sequence can be controlled external of the pressure vessel or the bags can be configured to pressurize/inflate sequentially.

Particular embodiments include aspects that may be described as follows:

A key code system for a fluid dispensing assembly, comprising:

a cap assembly including cap body, a first gross alignment structure and a cap key code ring, said cap key code ring defining a shoulder of said cap assembly and including at least one slot accessible from above said cap assembly; and a dispense head assembly operatively coupled with said cap assembly, said dispense head assembly including a second gross alignment structure and a dispense head key code ring, said dispense head key code ring including at least one protrusion, said at least one protrusion being aligned with and disposed within said at least one slot, said second gross alignment structure cooperating with said first gross alignment structure to align said at least one protrusion with said at least one slot.

The key code system as described above wherein the cap key code ring is detachable from said cap body.

The key code system as described above wherein said protrusions extend downward from said key code ring.

The key code system as described above wherein said at least one slot and said at least one protrusion are of equal number.

The key code system as described above wherein one of said first gross alignment structure and said second gross alignment structure defines a notch.

A universal key code device for a fluid dispensing system, comprising:

a body having an upper surface and an outer perimeter and structure defining a plurality of slots proximate said outer perimeter, said slots extending through said upper surface, said body including an alignment structure for rotational alignment with one of a cap body of a cap assembly and a dispense head; and a plurality of key tabs, each bridging a corresponding one of said plurality of slots and at least partially obstructing access to said corresponding slot from said upper surface.

The universal key code device as described above wherein said plurality of key tabs and said plurality of slots are equal in number.

The universal key code device as described above wherein said plurality of key tabs are frangibly connected to said body.

The universal key code device as described above wherein said body is a ring.

The universal key code device as described above wherein said slots extend through said outer perimeter.

A dispensing system for dispensing a liquid, comprising:

a containment vessel that defines a footprint;

a cap body operatively coupled with said containment vessel, said cap body including diametrically opposed pins that project radially outward from said cap body;

a cam-actuated dispensing head operatively coupled with said cap body; and an actuator handle pivotally mounted to said cap body, said actuator handle including arcuate slots that engage said diametrically opposed pins to secure said cam-actuated dispensing head to said cap body, said actuator handle being contoured so that said actuator handle is within said footprint of said containment vessel when said cam-actuated dispensing head is fully engaged with said cap body.

The dispensing system as described above further comprising a handling loop projecting radially outward from said cap body, said handling loop extending proximate a distal portion of said actuator handle.

The dispensing system as described above wherein said dispensing head includes detents and said actuator handle includes sockets that engage said detents when said cam-actuated dispensing head is fully engaged with said cap body.

The dispensing system as described above further comprising a dip tube portion having a distal end, said dip tube portion depending from said dispensing head, said dip tube portion including a passage on the exterior, said passage terminating proximate said distal end of said dip tube portion.

A dispensing system for dispensing a liquid, comprising:

an inner flexible container for containing said liquid and having an outer surface, said inner flexible container including a first sheet material comprising polytetrafluoroethylene, said sheet material having a thickness less than 0.25 millimeters;

an outer flexible member substantially surrounding said inner flexible container, said outer surface of said inner flexible container being substantially sealed by said outer flexible member, said outer flexible member including a second sheet material that is less permeable to gases than said polytetrafluoroethylene and having a thickness less than 0.25 millimeters; and a containment vessel defining an interior chamber, said inner flexible container and said outer flexible member being disposed within said interior chamber and being confined by said containment vessel.

The dispensing system as described above, wherein said second sheet material includes polyethylene.

A photolithographic processing system comprising:

a lithographic processor, a receiver for a containment vessel;

a pressurized gas source; and a containment vessel disposed in said receiver and containing resist fluid and comprising a flexible polymer dispense container for dispensing the photoresist liquid positioned in the containment vessel, the flexible polymer dispense container having a fluid flow connection to exterior of the containment vessel to dispense the photoresist liquid;

a flexible pressurization container positioned in a confronting relation to the dispense container in the containment vessel, the pressurization container connectable to the pressurized gas source exterior the containment vessel whereby said pressurization container may inflate for forcing photoresist liquid in the dispense container out of the containment vessel and to the lithographic processor.

The photolithographic processing system as described above wherein said containment vessel is a rigid container.

BRIEF DESCRIPTION OF THE FIGURES

FIG. 33 is a partial perspective view of a dispense head and a bag-in-bag-in-bottle device, the dispense head having an extended dip tube in an embodiment of the invention.

FIG. 37 is an exploded view of a dispensing head having a snap lock handle with groove and socket structure that cooperates with detents to lock the handle in place in an embodiment of the invention.

DETAILED DESCRIPTION

Figure 1:
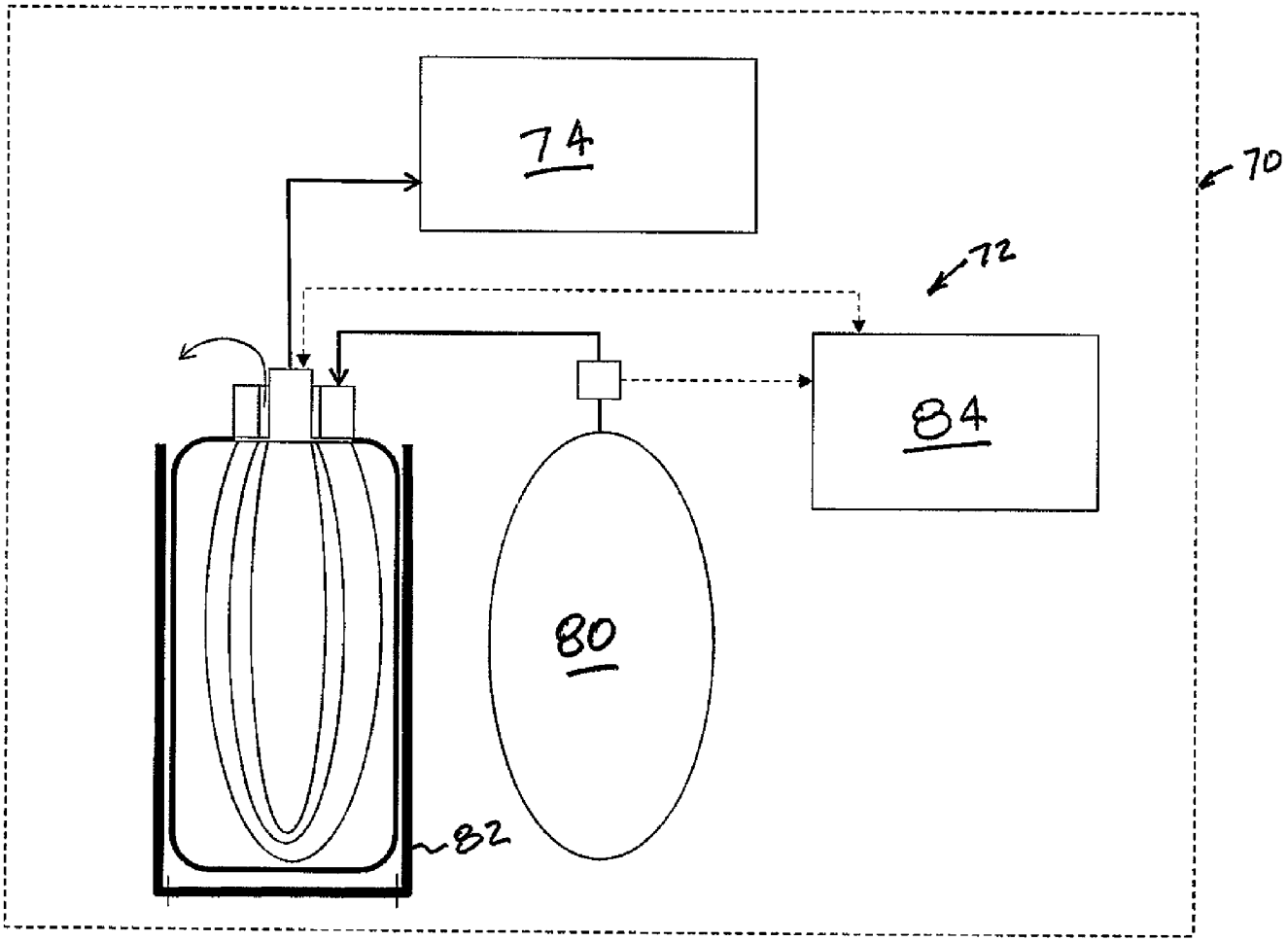
FIG. 1 is a schematic of a dispensing system in an embodiment of the invention.

Referring to FIG. 1, a photolithography system 70 including a dispensing system 72 for supplying a lithographic processor 74 is depicted in an embodiment of the invention. The dispensing system 72 includes a pressure source 80 operatively coupled to a bag-in-bag-in-bottle device 100 that is disposed in a receiver 82. A process controller 84 may be operatively coupled to the dispensing system 72 for control and monitoring of the pressure source 80 and the bag-in-bag-in-bottle device 100.

Figures 2, 2A:
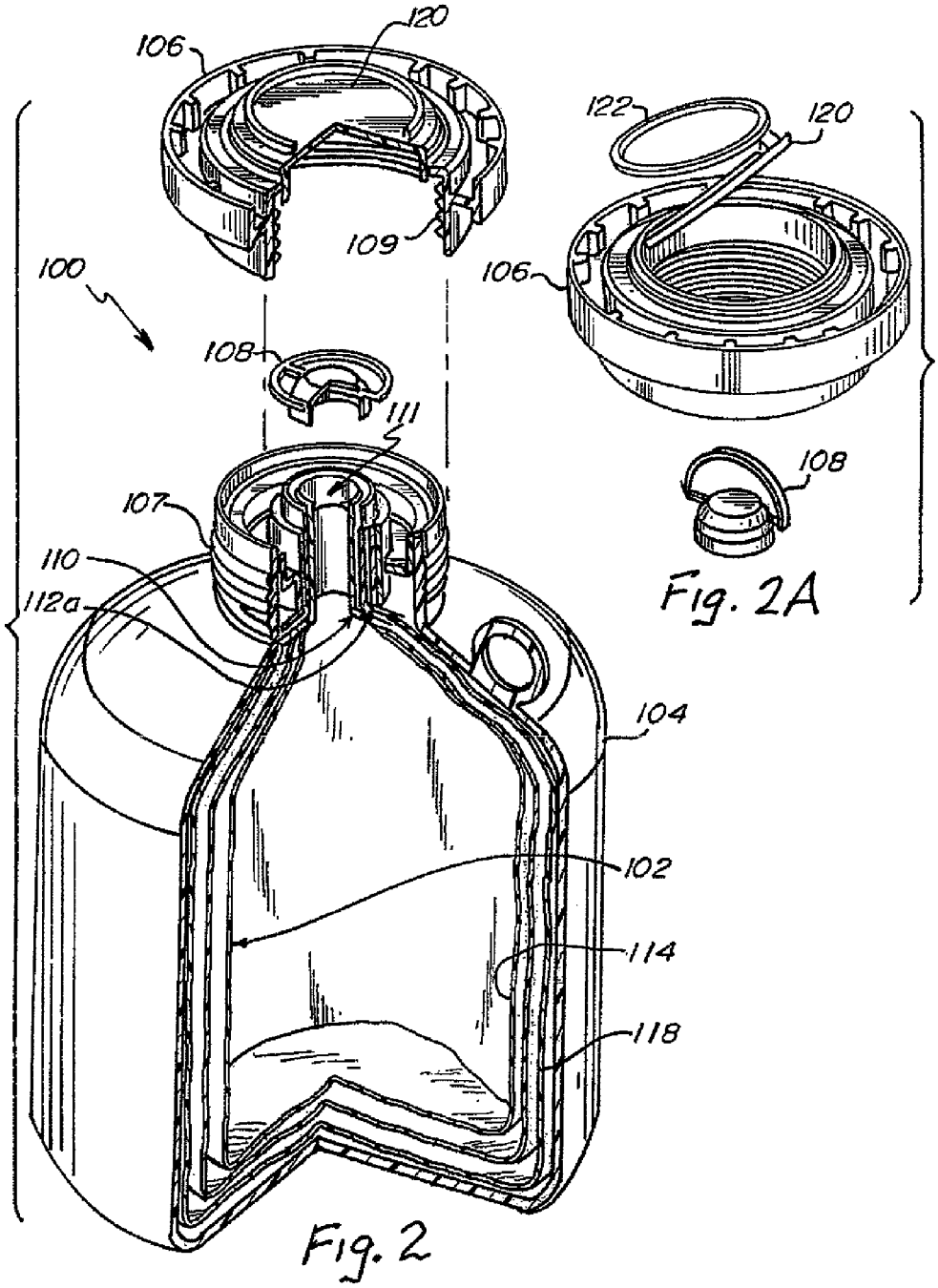
FIG. 2 is a perspective view of a bag-in-bag-in-bottle assembly in an embodiment of the invention.
FIG. 2A is an isolation view of the cap of the bag-in-bag-in-bottle assembly of FIG. 2.
Figure 2B:
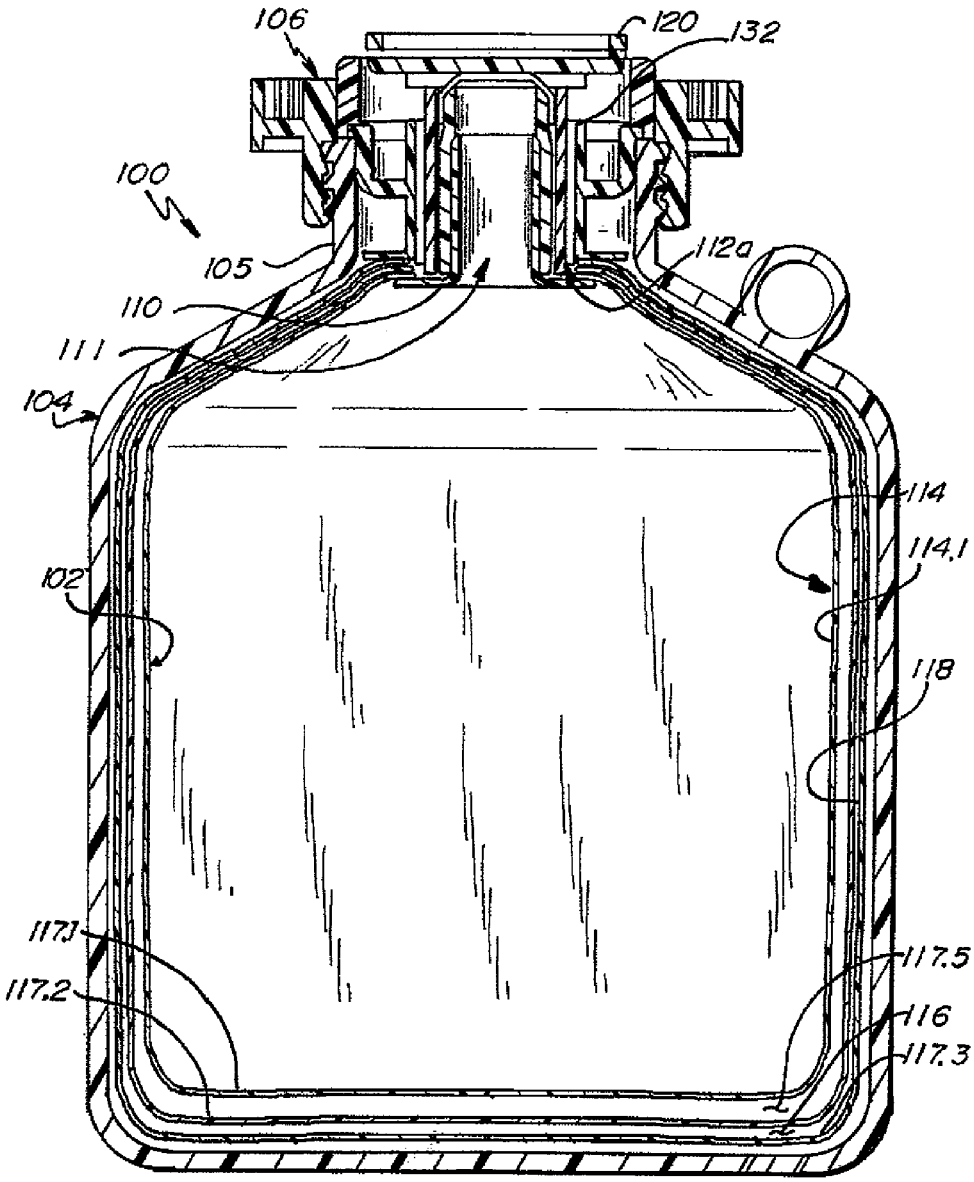
FIG. 2B is a sectional view of the bag-in-bag-in-bottle assembly of FIG. 2.

Referring to FIGS. 2, 2A and 2B, a representative embodiment of the bag-in-bag-in-bottle device 100 comprising a flexible bag-in-bag assembly 102, a containment vessel 104, and a cap assembly 106 is depicted in an embodiment of the invention. The bag-in-bag assembly 102 comprises an inner dispensing fitment 110 nested inside an outer fitment 112*a*, and an inner flexible container 114 nested inside a dual-walled outer flexible container 118. The inner dispensing fitment 110 is joined to the inner flexible container 114. The outer fitment 112*a* is joined to the outer flexible container 118. An interior cavity 116 is formed by the dual walls of the outer flexible container 118 such that the contents of the outer flexible container 118 are insulated from the walls of the inner flexible container 114.

The containment vessel 104 may be constructed of a rigid plastic material suitable for storing and transporting the bag-in-bag assembly 102. The containment vessel 104 can be formed with a neck portion 105 that defines a mouth into the containment vessel 104 and engages with the cap assembly 106 to be secured. The neck portion 105 may include a structure such as threads 107 for securing the cap assembly 106 to the containment vessel 104. Alternative embodiments can include containers constructed of glass, stainless steel, or other material as necessary, and mating structures other than threads.

The cap assembly 106 is generally constructed of a rigid plastic material identical to the material of the containment vessel 104 or of another appropriate material, for example fluoropolymers for sealing the container. Cap assembly 106 can include a peel-off access cover 120 for easy access to the inner dispensing fitment 110 and the outer fitment 112*a*. The peel-off cover 120 can include a tab (not pictured) or ring 122 to augment removal of the cover 120 from the cap assembly 106.

Figure 3A:
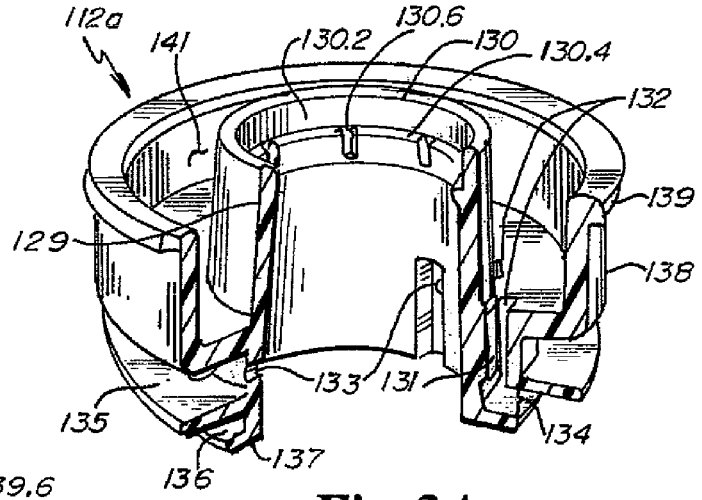
FIG. 3A is a perspective cutaway view of a single-piece outer fitment in an embodiment of the invention.
Figure 3B:
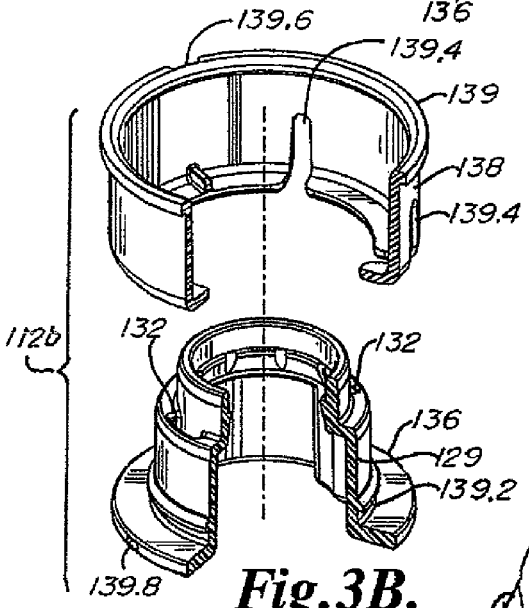
FIG. 3B is a perspective cutaway view of a two-piece outer fitment in an embodiment of the invention.
Figure 4:
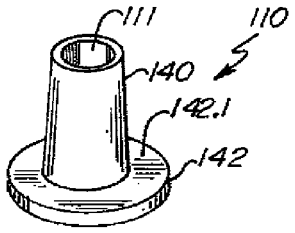
FIG. 4 is a perspective view of an inner dispensing fitment in an embodiment of the invention.

Referring to FIGS. 3A, 3B and 4, embodiments of the outer fitment 112*a* and the inner dispensing fitment 110 are depicted. The outer fitment 112*a* may include a central portion 129 that defines a hollow central passageway 130 having an interior surface 130.2. The hollow central passageway 130 may be sized to accommodate inner dispensing fitment 110 when the two fitments and their associated flexible containers 114, 118 are mated together.

The interior surface 130.2 of the outer fitment 112*a* may include a centering structure 130.4 having bypass slots 130.6 formed therein. The outer fitment 112*a* can also have a plurality of pressurization supply passageways 131 that extend through the outer fitment 112*a* and connecting inlet/outlet ports 132 and 134 for dispensing a fluid (e.g., nitrogen gas) into the interior cavity 116 of the outer flexible container 118 through a plurality of openings 134 at a base portion 136 of the outer fitment 112*a*.

The outer fitment 112*a* may be a single piece (FIG. 3A) and may include a base flange 137 of the base portion 136 that receives and seals against the interior surface of the outer flexible container 118 whereby the space comprising the interior cavity 116 is pressurizable with a pressurization fluid 342 such as nitrogen gas. The outer fitment 112*a* may also comprise a second flange portion 135 that extends radially from the central portion 129, the second flange portion 135 having an upwardly facing surface and a downwardly facing surface, either of which may receive and seal to the outer flexible container 118 (FIG. 2B). The outer fitment 112*a* may also include a bridging structure 138 having a distal portion 139 configured to support the bridging structure 138 from the neck portion 105 when assembled in the containment vessel 104. The bridging structure 138 may cooperate with the exterior of the hollow central passageway 130 to define a continuous annular channel 141.

Figure 32B:
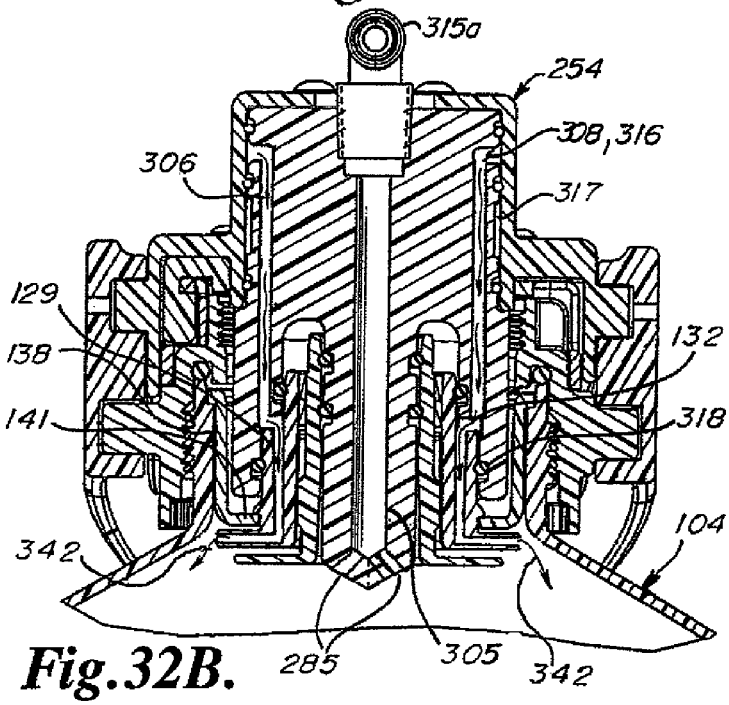
FIG. 32B is a partial sectional view of the cam-actuated dispensing head in assembly with a bag-in-bag-in-bottle device having a two-piece outer fitment in an embodiment of the invention.

Alternatively, an outer fitment 112*b* may comprise a two-piece configuration (FIG. 3B) wherein the bridging structure 138 is formed separately from the central portion 129. The bridging structure 138 may cooperate with a detent 139.2 that protrudes radially from the central portion 129 to secure the bridging structure 138 to the central portion 129. The bridging structure 128 may include flexure slots 139.4 that augment the elastic deformation as the bridging structure 128 passes over the detent 139.2 during assembly. The distal portion 139 of the bridging structure 138 may further include one or more notches 139.6 that cooperate with a mating structure on the containment vessel 104 to align the bridging structure in a particular orientation relative to the containment vessel 104. In the depicted embodiment, the inlet ports 132 may be in fluid communication with an exit port 139.8 that extends radially through the base portion 136 (see discussion attendant FIG. 32B for more details). Note also that the configuration presented in FIG. 3B has the base flange 137 without a structure akin to the second flange 135 of FIG. 3A.

The inner dispensing fitment 110 (FIG. 4) may comprise an upper portion 140 extending from a base portion 142 and defining a hollow central passageway 111 for dispensing the contents of the inner flexible container 114. The polymer member 114.1 (FIG. 2B) comprising the inner bag may be sealingly fixed to the upwardly facing surface 142.1 of the inner dispensing fitment 110 such as by welding. In one embodiment, the upper portion 140 of the inner dispensing fitment 110 is at least equal to the length of the outer fitment 112*a* or 112*b*, enabling the inner dispensing fitment 110 to extend through the hollow central passageway 130 of the outer fitment 112*a* or 112*b* so that a cap 108 can seal the inner dispensing fitment 110. In one embodiment, the upper portion 140 of the inner dispensing fitment 110 and the hollow central passageway 111 cooperate to define an annular venting passage 113 (FIG. 21) that vents to ambient via the bypass slots 130.6. A base 142 of the inner dispensing fitment 110 may be secured to the base portion 136 of the outer fitment 112*a* or 112*b*. In various embodiments the inner dispensing fitment 110 may be secured to the outer fitment 112*a* or 112*b* by detents, interference fit, adhesion or by other mechanisms that securely join the two components together.

The outer fitment 112*a* or 112*b* may also include one or more radial holes 133 located between the second flange portion 135 and the bridging structure 138 and passing through the central portion 129. In this embodiment, radial holes 133 enable gas that is otherwise trapped between the outer flexible container 118 and the containment vessel 104 to be vented via the annular venting passage 113.

The plurality of bags configuration of FIGS. 2 and 2B may in one potential embodiment comprise three discrete concentrically arranged bags 117.1, 117.2 and 117.3, whereby the first bag 117.1 receives, stores, and dispenses the dispense fluid, such as photoresist. The second bag 117.2 contains the first bag, and the third bag 117.3 contains the second bag 117.2. The pressurization fluid may be injected between the second bag 117.2 and the third bag 117.3 (i.e. the interior cavity 116 between the second and third bags 117.2 and 117.3). A space 117.5 between the first bag 117.1 and the second bag 117.2 can be vented to the exterior through the annular venting passage 113. This venting is desirable in order to prevent the formation of micro-bubbles in the interior or the first bag 117.1 due to gas permeating through the first bag 117.1. In an alternative embodiment, the middle and outer members that form the outer flexible container 118 containing the interior cavity 116 comprise a single bag which may be configured as described below.

Figure 5:
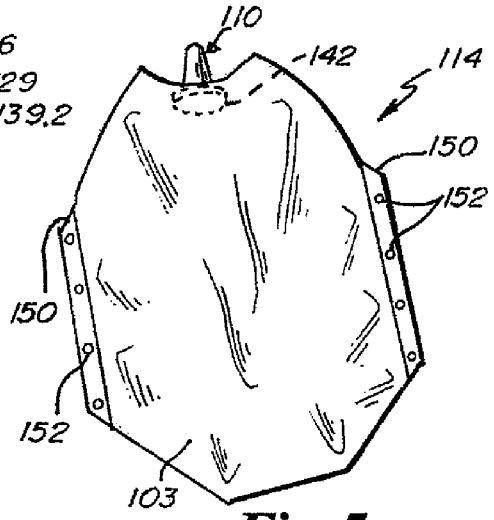
FIG. 5 is a side view of an assembled inner flexible container in an embodiment of the invention.
Figure 6:
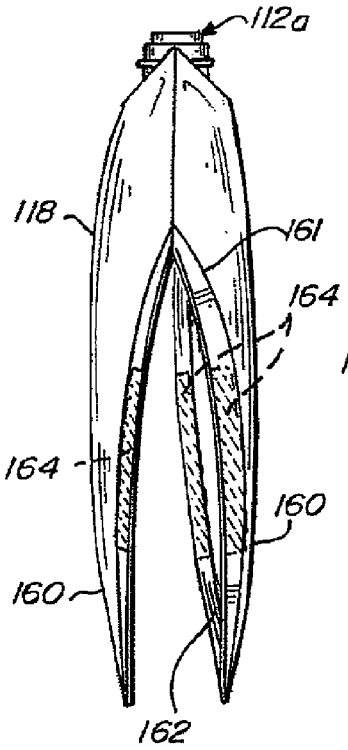
FIG. 6 is an end view of an assembled an outer flexible container having two side portions in an embodiment of the invention.
Figure 7:
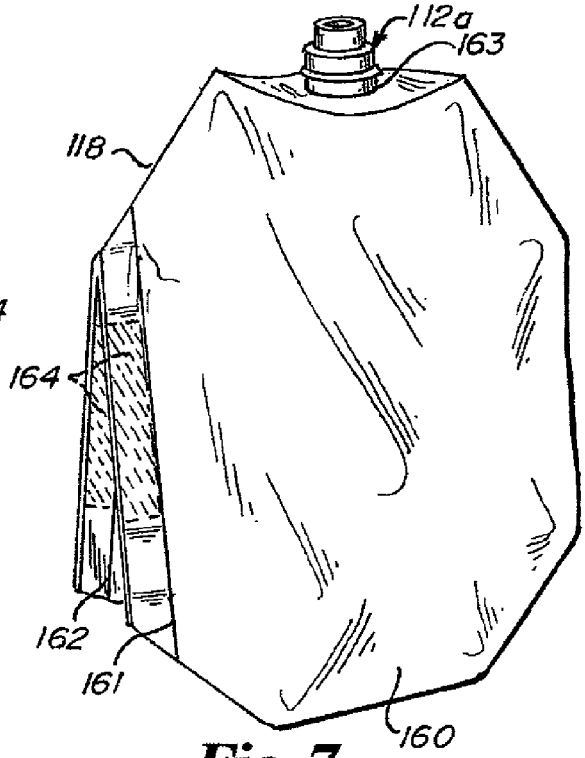
FIG. 7 is a side view of the assembled outer flexible container of FIG. 6.

Referring to FIG. 5, the inner flexible container 114 is depicted in an embodiment of the invention. Various embodiments of the bag-in-bag assembly 102 are generally constructed of two separate flexible containers, i.e. the inner flexible container 114 and the outer flexible container 118. The inner flexible container 114 can be formed by sealing the inner dispensing fitment 110 in a hole in the center of a rectangular, octagonal, or other custom shaped sheet of material 103.

The sheet of material 103 may comprise perfluoroalkoxy (PFA) or other appropriate fluoropolymer material. Typically, the sheet of material 103 is less than 0.25-mm (0.010-in.) thickness to provide the desired flexibility. In one embodiment, the sheet of material 103 is a two-layered arrangement formed by a co-extruding process, with the inner layer being made of PFA of 0.05-mm (0.002-in.) thickness and the outer layer being made of a modified polytetrafluoroethylene (PTFE) layer, also of 0.05-mm thickness.

The custom shaped sheet of material 103 may be folded substantially in half such that the two halves can be sealed around the perimeter forming the inner flexible container 114 with the dispensing fitment 110 located at the upper portion of the container 114 as depicted in FIG. 5. The dispensing fitment 110 can be attached to the sheet of material 103 with an adhesive, or welded with heat, or another appropriate method of fastening the two materials together. Along the sides of the inner flexible container 114 a larger seam can be welded together to form an attaching tab 150. The attaching tab 150 can be of varying dimensions depending on the volume of the inner flexible container 114. In one embodiment the attaching tab 150 can be approximately one-half inch in width and possess a plurality of holes 152.

Figure 12:
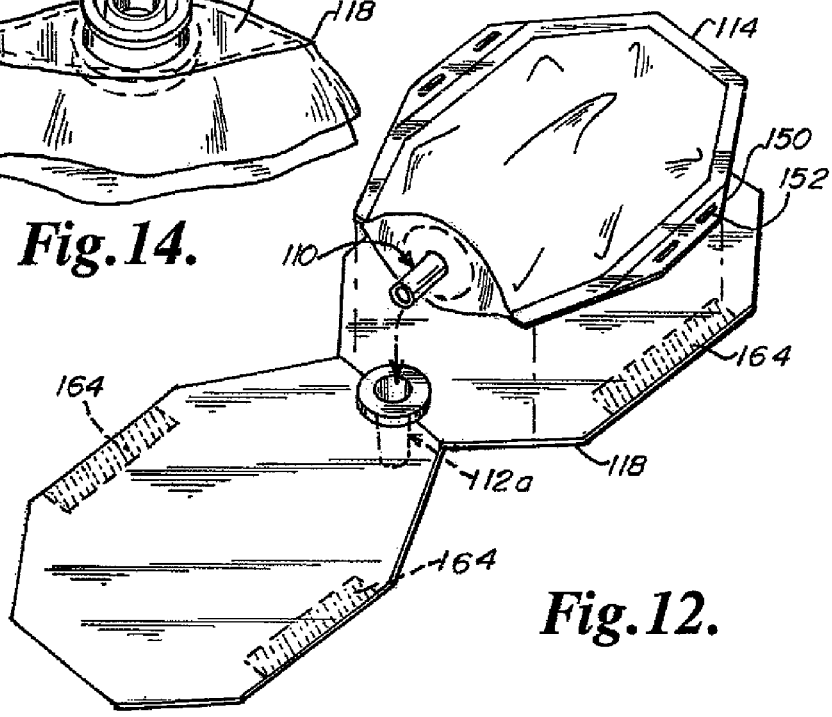
FIG. 12 is a perspective view of the assembly of a bag-in-bag assembly in an embodiment of the invention.

A non-limiting configuration for the holes 152 is 6.4-mm diameter (0.25-in.) on centers spaced approximately 12.3-mm (0.5-in.) apart. The holes 152 should be positioned on the attaching tab 150 so as not to reduce the integrity of the seal around the perimeter of the inner flexible container 114. The holes 152 in the attaching tab may be of any shape (e.g., circular, square, triangular) and need not be circular. Alternative elongated holes can provide a larger area for the seam allowance portions 164 to come into contact with each other (e.g., as depicted in FIG. 12).

Referring to FIGS. 6 through 15, an example configuration for the bag-in-bag assembly 102 is illustrated in an embodiment of the invention. In one embodiment, the outer flexible container 118 is formed from an outer portion or member 160 and an inner portion or member 162 of a non-permeable material such as of polyethylene (PE). The outer member 160 and inner member 162 may be joined together along their common perimeters as well as along a seal line 161 to form the air-tight outer flexible container 118 by processes available to the artisan (e.g., welding). The seal line 161 may be inset from the perimeter of the outer member 160 and inner member 162 of the outer flexible container 118 to define a seam allowance portion 164 along at least a portion of the edges of the outer flexible container 118. The seam allowance portion 164 may be equal to or larger than the attaching tab 150 of the inner flexible container 114.

The thickness of the inner and outer members 162 and 160 will typically be less than 0.25-mm (0.01-in.) for flexibility. In one embodiment, the inner and outer members 162 and 160 are comprised of five layers that are co-extruded to form a sheet material that is approximately 0.08-mm (0.003-in) thickness. The five layers in this embodiment are a polyethylene outer layer, a nylon sublayer, a ethylene vinyl alcohol (EVOH) midlayer, another nylon sublayer, and another polyethylene layer as the inner layer.

The outer and inner members 160 and 162 of the outer flexible container 118 can each include structure that defines an aperture 163, within which the outer fitment 112*a* or 112*b* is disposed. The apertures 163 may be of a diameter that is less than the diameter of the base 136 and second flange portion 135 of the outer fitment 112*a*, but large enough to accommodate the central portion 129 of the outer fitment 112 (FIG. 3A).

Figure 9:
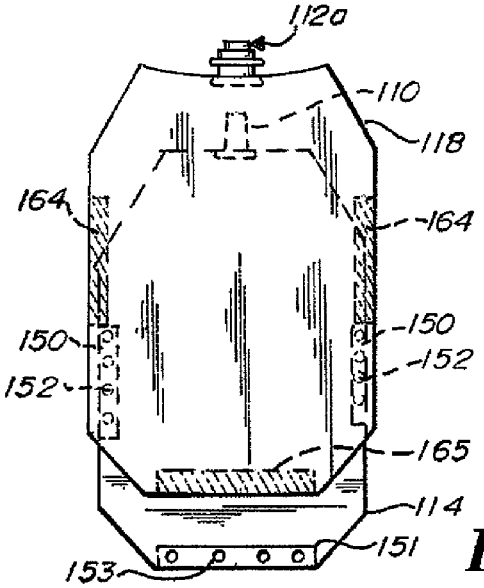
FIG. 9 is a side view of the assembled inner flexible container of FIG. 6 being inserted between the two side portions of an assembled outer flexible container.

The embodiment of FIG. 9 also depicts an additional lower attaching tab 151 located at the bottom portion of the inner flexible container 114 and having a plurality of holes 153 akin to the side attaching tabs 150. A corresponding seam allowance portion 165 is located at the bottom portion of each half of the outer flexible container 118 in the depicted embodiment.

In assembly, the perimeter seal and seal line 161 may be formed by applying heat along the edges of the outer member 160 and inner member 162 such that they are welded together to form the outer flexible container 118. When the single-piece outer fitment 112*a* (FIG. 3A) is implemented, the outer fitment 112*a* may be inserted through the apertures 163 so that the outer member 160 is in contact with the second flange portion 135 of the outer fitment 112 and the inner member 162 is in contact with the upper face of the base portion 136 of the outer fitment 112. The outer and inner members 160 and 162 may then be sealed to the second flange portion 135 and the base 136, respectively.

Where the two-piece outer fitment 112*b* (FIG. 3B) is implemented, the outer fitment 112*b* sans the bridging structure 138 may be inserted through the apertures 163 so that the outer member 160 is in contact with the upper surface of the base flange 137 of the base portion 136, and the inner member 160 is in contact with the lower surface of the base flange 137. The need for a second flange (e.g., flange 135 in FIG. 3A) can be eliminated because, during the absence of the bridging structure 138, the top of the base flange 137 is accessible for bonding with the outer member 160. Also, the apertures 163 may be of the same size on the outer and inner members 160 and 163 so that both components may be identically constructed.

The exit port 139.8 of the two-piece outer fitment 112*b* is in fluid communication with the interior cavity 116 of the outer flexible container 118 after assembly of the outer and inner members 160 and 162. The bridging structure 138 may be attached to the central portion 129 in a variety of ways, including snapping on over the detent 139.2 (as depicted), screwed on to a threaded structure, glued on with an adhesive, or by other techniques available to the artisan. The sealing of the outer fitment 112*a* or 112*b* to the outer and inner members 160 and 162 may be accomplished with an adhesive, by heat welding, or by other mechanisms available to the artisan.

Alternatively, the assembly of the outer flexible container 118 may be accomplished by sandwiching the outer fitment 112 between the outer member 160 and the inner member 162, at the location of apertures 163. In this manner the size of the apertures 163 in both the outer member 160 and inner member 162 can be reduced. Typically, the aperture 163 of the outer member 160 will be larger than that of the lower member 162, as the aperture of the lower member 162 need only be as large as hollow central passageway 130 of the outer fitment 112.

Figure 8:
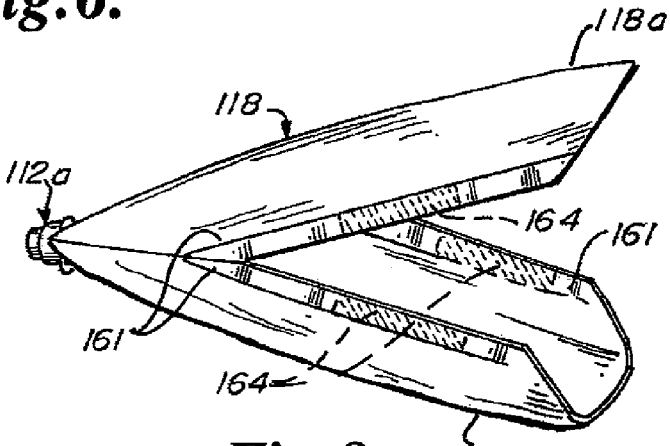
FIG. 8 is a side view of the assembled outer flexible container of FIG. 6 with portions spread apart to receive an inner flexible container.

In one embodiment, the bag-in-bag assembly 102 is assembled by folding the outer flexible container 118 over the inner flexible container 114. Two portions 118*a* and 118*b* of the outer flexible container 118 are depicted in FIG. 8 as being spread apart to receive the inner flexible container 114. Assembly of the inner flexible container 114 within the center of the outer flexible container 118 is portrayed in FIG. 9. Placement of the inner flexible container 114 between the two portions 118*a* and 118*b* of outer flexible container 118 is best depicted in FIGS. 12 and 13.

Figure 10:
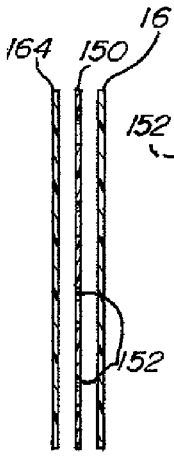
FIG. 10 is an end view of a weld assembly in an embodiment of the invention.
Figure 11:
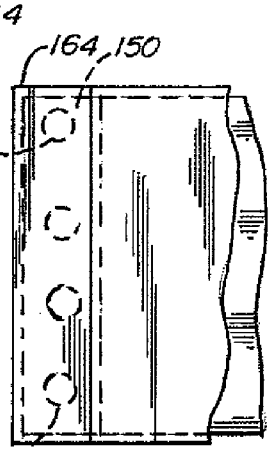
FIG. 11 is a side view of weld assembly of FIG. 10.
Figure 14:
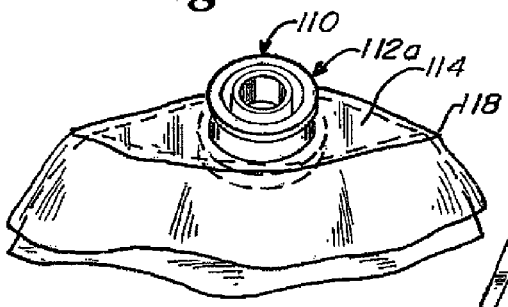
FIG. 14 is a top view of the assembled fitments of a bag-in-bag assembly of FIG. 12.
Figure 13:
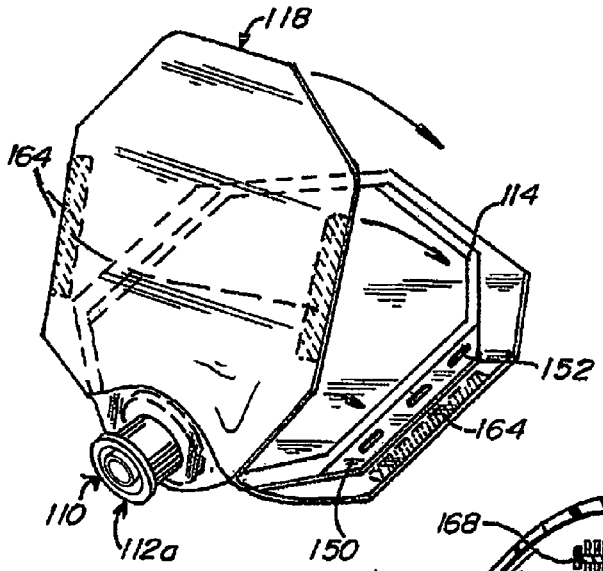
FIG. 13 is another perspective view of the bag-in-bag assembly of FIG. 12.

During assembly, the inner dispensing fitment 110 may be extended through the apertures 163 and into the outer fitment 112 (FIGS. 12 and 13). The inner and outer flexible containers 114 and 118 may be aligned so that opposing seam allowance portions 164 are on both sides of the through holes 152 of the attaching tab 150 (FIGS. 10 and 11). The opposing seam allowance portions 164 are then attached to each other through the through holes 152 to form the bag-in-bag assembly 102. The attachment may be accomplished by heat welding, adhesion, or other fastening techniques available to the artisan.

The attaching tab 150 may be comprised of one material type such as PFA, with the two seam allowance portions 164 of a different material type such as PE. The holes 152 eliminate the problem of joining two materials having different welding temperatures together by enabling the two outer seam allowance portions 164 to be directly welded together through the holes 152 in the attaching tab 150. In this example the weld creates a PE-PFA-PE seam that can securely hold the inner flexible container 114 between the two sides of the outer flexible container 118. When welding the two seam allowance portions 164 directly together through the holes 152, only enough heat to fuse the material and thickness of the outer flexible container 118 is required.

Functionally, the fixed alignment of the inner flexible container 114 and the outer flexible container 118 at the attaching tabs 150 and the seam allowance portions 164 holds the outer flexible container 118 in a fixed relationship with the inner flexible container 114 so that upon inflation, the outer flexible container 118 does not creep up or down or laterally with respect to the inner flexible container 114. By this arrangement, the contents of the inner flexible container 114 may be more thoroughly expunged. The lower attaching tab 151 and the lower seam allowance portion 165 provide an additional point to fix the alignment between the inner and outer flexible containers 114 and 118 in order too further aid in the expulsion of the contents of the inner flexible container 114.

Figure 15:
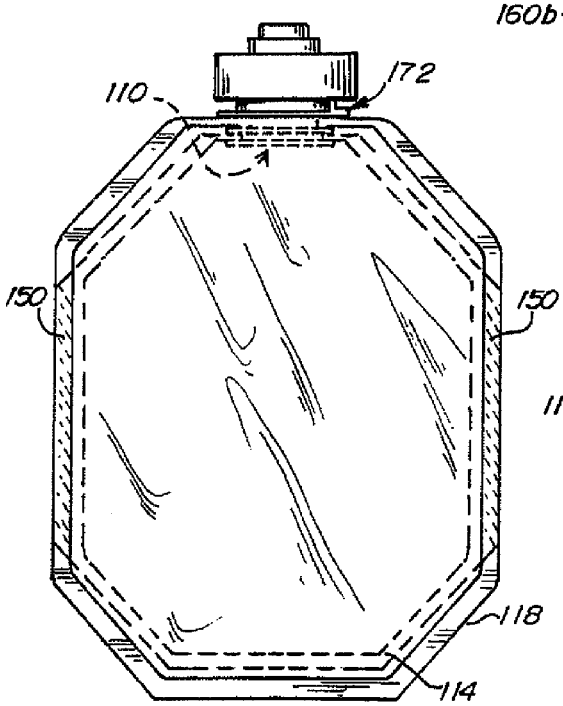
FIG. 15 is a side view of the bag-in-bag assembly of FIG. 12 with an attached RFID device in an embodiment of the invention.

A configuration wherein two zones where the attaching tab 150 of the inner flexible container 114 and seam allowance portion 164 of the outer flexible container 118 are physically attached together to complete the bag-in-bag assembly is depicted in FIG. 15. A radiofrequency identification (RFID) device 172 is also depicted in FIG. 15 near the top of the assembly. This RFID device 172 can be used to store data related to the contents and disposition of the assembly, including but not limited to, the age, contents, fill date, capacity, and manufacturer of the bag-in-bag assembly.

Figure 16:
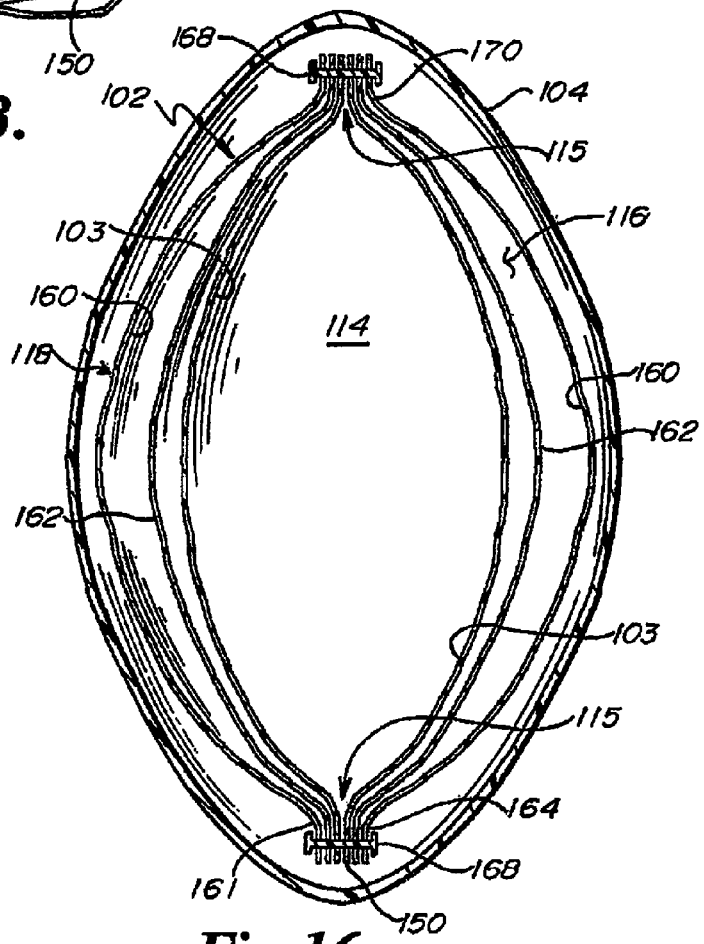
FIG. 16 is a sectional view of the bag-in-bag assembly of FIG. 13 housed inside a containment vessel in an embodiment of the invention.

Referring to FIG. 16, the bag-in-bag assembly 102 is positioned inside the containment vessel 104 in an embodiment of the invention. As described above, the inner flexible container 114 is comprised of the single sheet of flexible material 103 which is sealed around its perimeter by heat-welding the material together to form a seal 115. Similarly the outer flexible container 118 may be formed by sealing an inner member 162 and an outer member 160 together by heat-welding the material together to form a seal 170. The outer flexible container 118 is then folded in half to form a saddle-bag like configuration such that the inner member 162 is in physical contact with the exterior surface of the inner flexible container 114 on each side. In the depicted embodiment, the attaching tab 150 of the inner flexible container 114 and the seam allowance portions 164 of the outer flexible container 118 may be physically connected with fasteners 168. The fasteners 168 can be in the form of a plurality of plastic rivets. Other mechanical fastening devices such as clamps or screws may be utilized to secure the two flexible containers together. Alternatively, or in addition, the inner and outer flexible containers can be fastened by adhesion or by melting the materials edges together to form a weld at or near the perimeter of the flexible containers as depicted in FIGS. 11 and 12.

Figure 17:
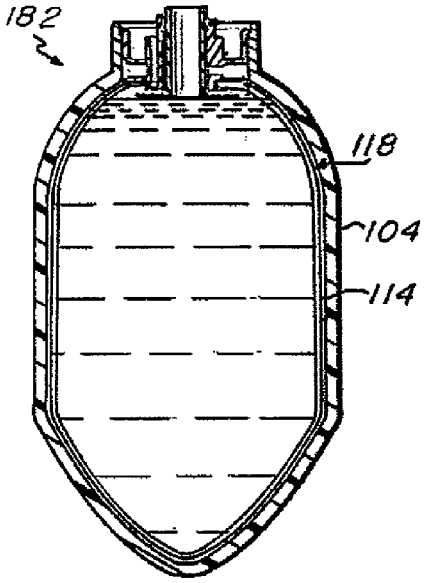
FIGS. 17, 18 and 19 are side views of the bag-in-bag-in-bottle assembly at various degrees of liquid extraction from the container in an embodiment of the invention.
Figure 18:
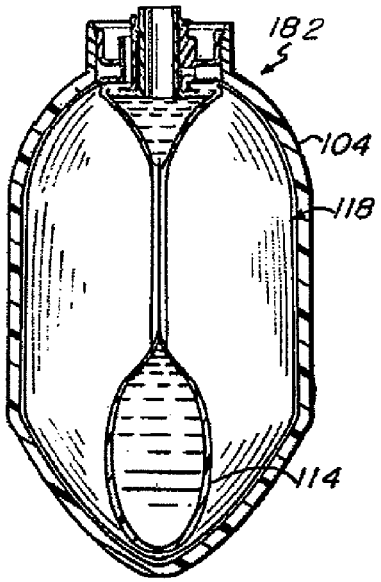
Figure 19:
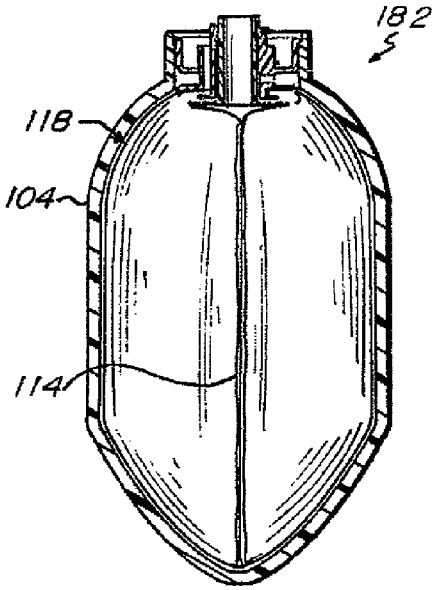
Figure 20:
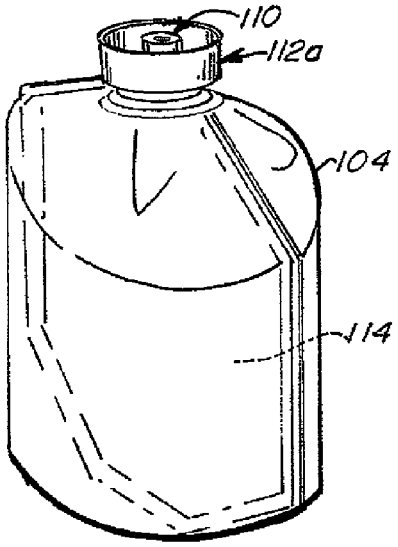
FIG. 20 is a side view of the bag-in-bag-in-bottle assembly of FIG. 19.

Referring to FIGS. 17, 18, 19 and 20, operation of a bag-in-bag-in-bottle device 182 is depicted in an embodiment of the invention. In FIG. 17, the inner flexible container 114 is completely filled with fluid, and the outer flexible container 118 has been emptied by the pressure exerted against it by the inner flexible container 114 as it was filled and its outer surface pressed against the inner surface of the containment vessel 104 that houses the bag-in-bag assembly. FIG. 18 depicts the assembly after a portion of the fluid contained in the inner flexible container 114 has been dispensed due to the pressure created by the introduction of a gas such as nitrogen into the outer flexible container 118. As more gas is introduced into the outer flexible container 118 the inner flexible container 114 is uniformly compressed. This uniform compression can result in nearly total dispensation of the fluid contained in the inner flexible container 114 as depicted in FIGS. 19 and 20.

Figure 18A:
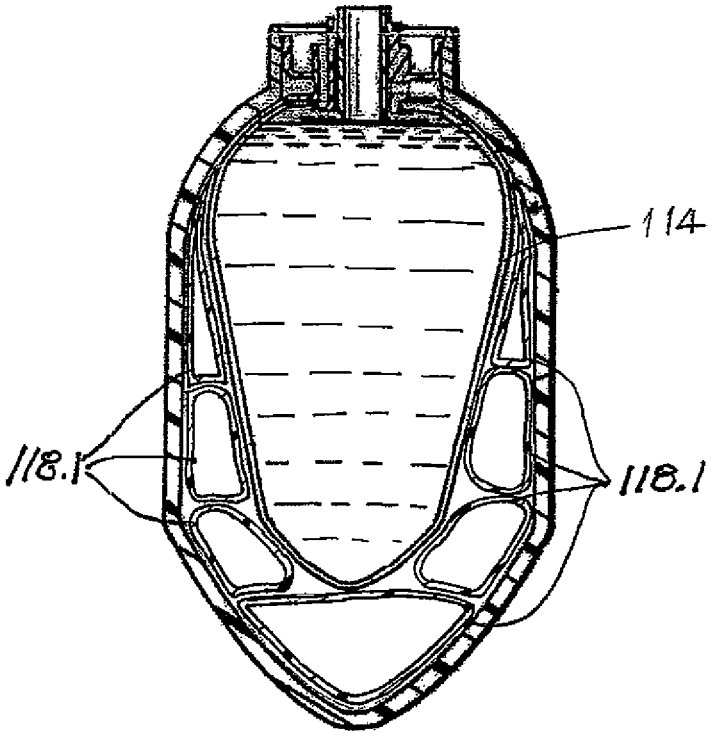
FIG. 18A is a sectional view of an assembly with a plurality of axially aligned pressurization bags.

Referring to FIG. 18A, an embodiment of the invention is depicted wherein a plurality of pressurization bags 118.1 may be placed adjacent the dispense bag and arranged axially, that is with their axes extending in a generally vertical direction in the pressure vessel. Such pressurization bags may be differentially pressurized or staged to facilitate a more complete dispensing from the dispense bag 114. Generally such pressurization may be controlled external the pressure vessel but can also be part of the plurality of bags, such as restricted pathways to sequential bags so that the lower most bag inflates/pressurizes first and then adjacent bags inflate/pressurize. Such sequential pressurization bags may be, for example, donut shaped and stacked or arranged surrounding the dispense bag.

Figure 21:
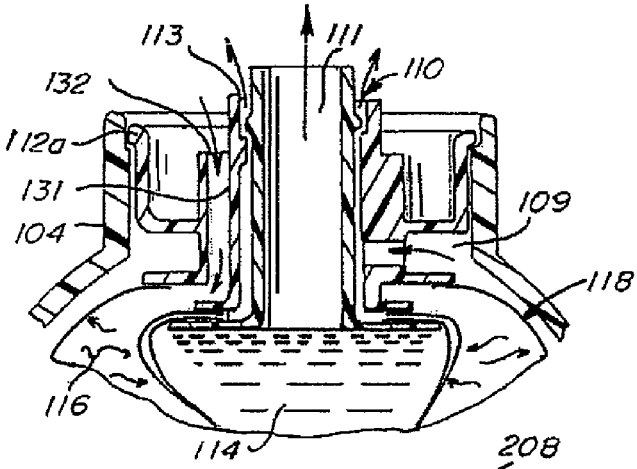
FIG. 21 is a partial sectional view of the bag-in-bag-in-bottle assembly of FIG. 18 in operation.

Referring to FIG. 21, the inner fitment 110 is depicted as being secured within the outer fitment 112 in an embodiment of the invention. The passageway 111 provides the necessary access to the interior of the inner flexible container 114 for the filling and dispensing of the liquid contents. The space between the inner fitment 110 and the outer fitment 112 defines the annular venting passage 113 between the inner flexible container 114 and the outer flexible container 118. The venting path enables gases that are otherwise trapped between the inner flexible container 114 and the outer flexible container 118 during manufacture or use of the assembly to escape. Allowing the otherwise trapped gas to escape through annular venting passage 113 helps to ensure that the inner flexible container 114 collapses in a uniform manner when pressurized gas is supplied to the outer flexible container 118 and mitigates against the gas permeating the inner flexible container 114 to form micro-bubbles.

The annular venting passage 113 is also in fluid communication with venting path 109 which enables gas which becomes trapped between the outer flexible container 118 and the containment vessel 104 during manufacture or use of the assembly to escape. The venting of any trapped gas from both of these spaces in the assembly helps to eliminate the formation of micro-bubbles in chemicals such as photoresist. The outer fitment 112 also contains a plurality of pressurization supply passageways 131 through the body of the outer fitment 112 that are in fluid communication with the interior cavity 116 of the outer flexible container 118. The pressurization supply passageways 131 enable a dispensing gas or fluid to be injected into the interior cavity 116 in order to provide the pressure necessary to inflate the outer flexible container 118 forcing the contents of the inner flexible container 114 out through the central passageway 111 of the inner fitment 110.

In another embodiment (not depicted), a liquid or gel may be placed interstitially between the inner and outer flexible containers 114 and 118 to inhibit gas from entering therebetween. Such a configuration would mitigate against the gases entering the interstitial region and becoming trapped against the inner container 114 during the pressurization process.

Figure 22:
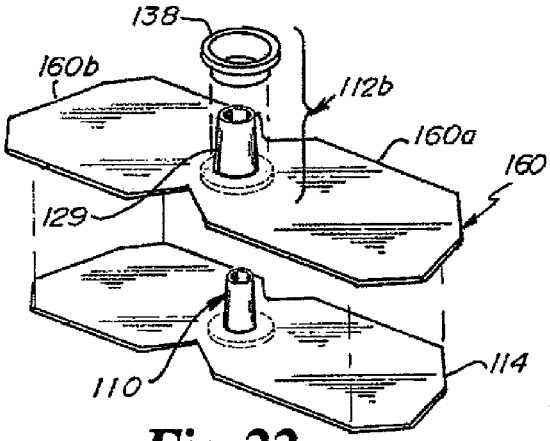
FIGS. 22 and 23 depict a wrapped bag assembly in an embodiment of the invention.
Figure 23:
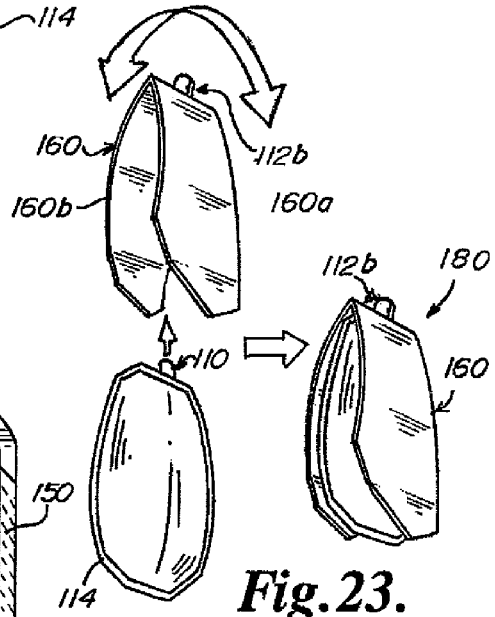

Referring to FIGS. 22 and 23, a wrapped bag assembly 180 is depicted as having the inner flexible container 114 wrapped by the outer member 160 only in an embodiment of the invention. The outer fitment 112 is depicted as being attached only to the outer member 160. In this embodiment, there is no inner member or stand alone outer flexible container. Rather, the outer member 160 cooperates with the inner flexible container 114 to define a plenum (not depicted). This embodiment eliminates the need for the additional inner member 162 as described in the above embodiments. When the perimeter of the outer member 160 is joined together with the inner flexible container 114 the flexible bag-in-bag assembly 102 is formed. The outer flexible member 160 is folded in half as depicted in FIG. 23 and the inner flexible container 114 is then inserted in between the two portions 160*a* and 160*b* of the outer flexible member 160. Once the members are fitted together they can be attached to each other by fastening the outer perimeters of the outer flexible member 160 and the inner flexible container 114 together by welding or other methods of bonding available to the artisan for the materials used.

The outer member 160 may be welded to itself through holes (e.g., such as holes 152 depicted in FIG. 13) on the peripheral region of the inner flexible container 114 for structurally securing the outer member 160 about the inner flexible container 114. In one embodiment, the outer member 160 may be sealed to the inner flexible container 114 near the perimeter of the inner flexible container to provide a gas-tight plenum.

Alternatively, the outer member 160 may be utilized as a gas barrier instead of defining the outer boundary of a plenum. In this alternative arrangement, gas is not pumped into the region between the flexible outer member 160 and the inner flexible container 114. Rather, the wrapped bag assembly 180 is pressurized externally as a unit to extract the liquid within the inner flexible container 114. The outer member 160 may be sealed to the inner flexible container 114 near the perimeter of the inner flexible container to inhibit gas from getting into the interstitial region between the inner flexible container 114 and the outer member 160.

Functionally, the alternative arrangement for the wrapped bag assembly 180 enables material for the inner flexible container 114 to be selected for enhanced or optimal containment of the liquid (e.g., selection of PFA to contain photoresist), while the selection of the outer flexible member 160 may be based on gas imperviousness (e.g., selection of PA as a barrier to nitrogen gas). In operation, the wrapped bag assembly 180 may be placed in a containment vessel (e.g., containment vessel 104 of FIG. 16) and the vessel pressurized to collapse the wrapped bag assembly to extract the fluid. The material of the inner flexible container 114 prevents or mitigates against seepage of the liquid, and the material of the outer member 160 mitigates against gas molecules penetrating the inner flexible container 114 and creating micro-bubbles within the liquid. Those skilled in the art will also recognize that the outer member 160 and inner flexible container 114 can be coupled to the outer fitment 112 in a way that vents residual gases that may be found therebetween.

Figure 24:
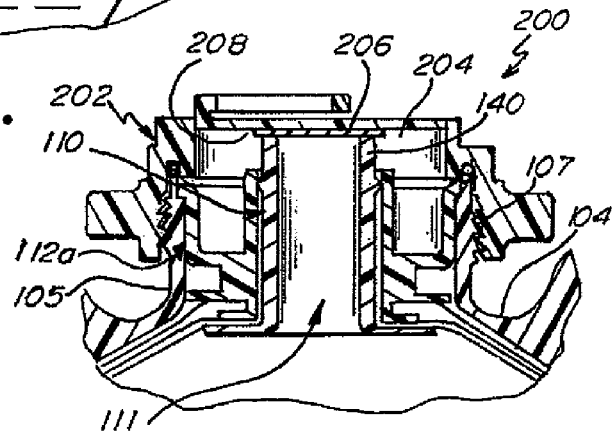
FIG. 24 depicts a cap system with a captive gasket sealing cap in an embodiment of the invention.

Referring to FIG. 24, a cap system 200 is depicted in another embodiment of the invention. In this embodiment, a cap 202 has a peel away top section 204 with a captive gasket 206 affixed to an inner surface 208 thereof. The cap 202 may be configured to threadably engage the threads 107 of the neck portion 105 so that the captive gasket 206 engages the upper portion 140 of the inner dispensing fitment 110 to seal the central passageway 111.

Figure 25:
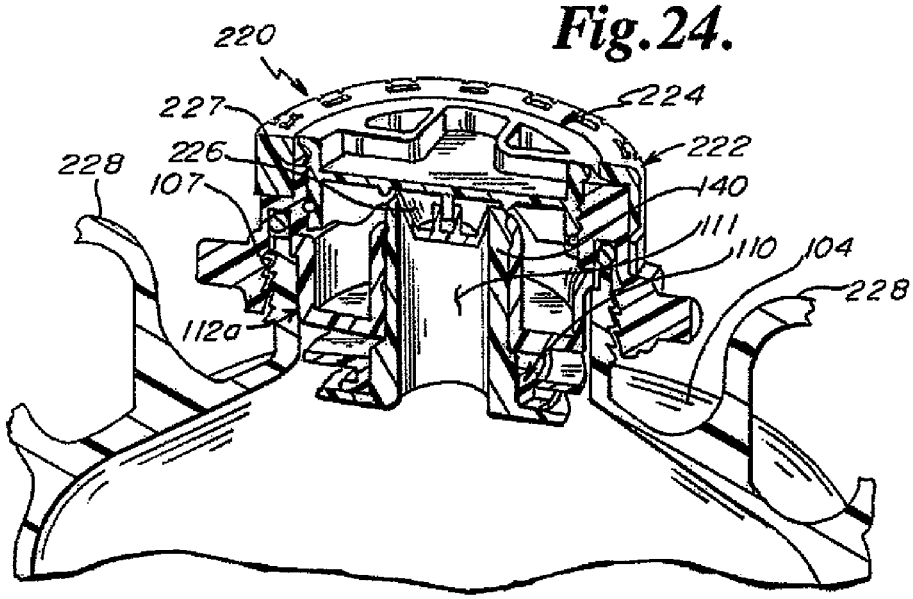
FIG. 25 is a partial sectional view of a sealing cap having a frustum plug in an embodiment of the invention.

Referring to FIG. 25, a cap system 220 comprising a cap 222 with a top member 224 operatively coupled with a conical or frustum-shaped plug 226 is depicted in an embodiment of the invention. The top member 224 may be engaged to the cap 222 with threads 227 (as depicted) or by other detachable engagement structure available to the artisan such as a snap fit or by employing detents. Alternatively, the top member 224 may be integrally formed with the cap 222. In either case, the cap 222 may threadably engage the threads 107 of the neck portion 105 so that the frustum-shaped plug 226 engages the upper portion 140 of the inner dispensing fitment 110 within the passageway 111 to provide a seal.

In operation, the cap systems 200 and 220 provide a one step procedure for sealing the bag-in-bag-in-bottle device 100 prior to shipping. The cap 202 or 222 is screwed on until the gasket 206 or frustum-shaped plug is exerted against the upper portion 140 of the inner dispensing fitment 110 with sufficient force to affect a seal.

The embodiment depicted in FIG. 25 also includes a pair of loop handles 228 that are formed integrally with the containment vessel 104. The loop handles 228 permit lifting and handling of the containment vessel 104 by an operator.

Figure 26:
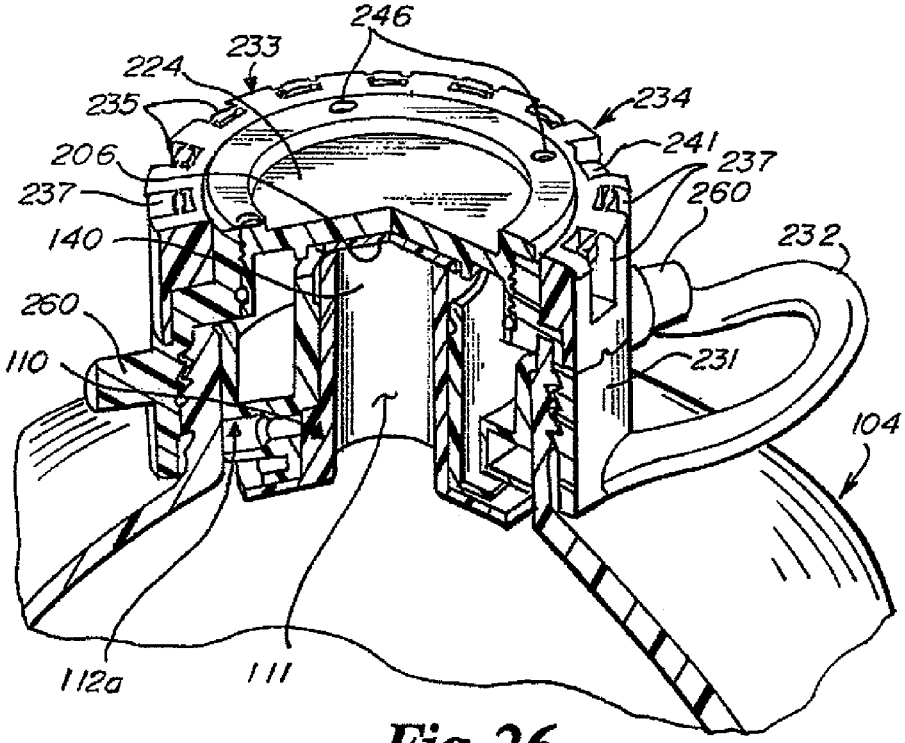
FIG. 26 is a partial sectional view of a bottle with a cap having a captive gasket and a handling loop in an embodiment of the invention.
Figure 27:
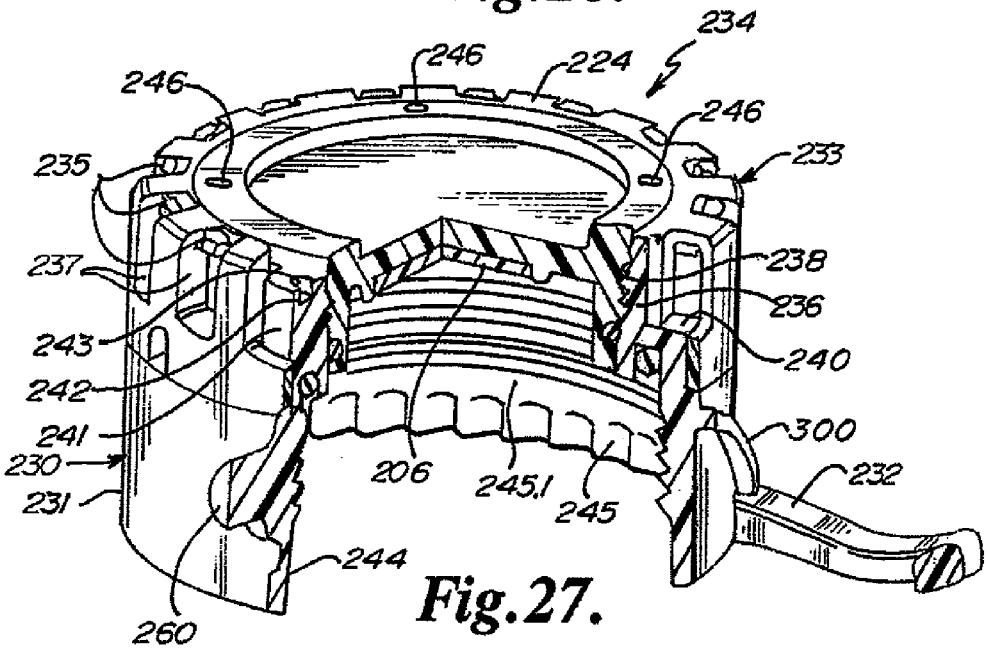
FIG. 27 is a partial cut-away perspective view of the cap of FIG. 26.
Figure 29:
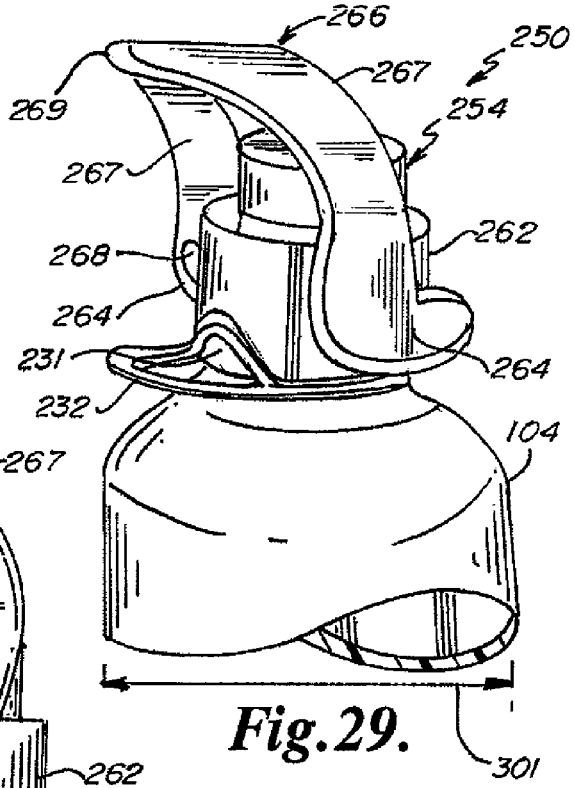
FIGS. 28 and 29 are partial perspective views of the bag-in-bag-in-bottle assembly and a profiled cam-actuated dispensing head in an embodiment of the invention.

Referring to FIGS. 26 and 27, a cap assembly 234 including a cap body 230 having a collar portion 231, a cap key code device 233 and cap handling loop 232 is depicted in an embodiment of the invention. The cap handling loop 232 may be integrally formed with the collar portion 231, and may extend generally radially outward on one side of the collar portion 231. Some embodiments may include a plurality of such cap handling loops (not depicted).

The cap key code device 233 may define the upper shoulder of the cap assembly 234 and may include a plurality of female key code slots 237 formed at the perimeter. A plurality of key tabs 235 that bridge across each of the female key code slots 237, as best depicted in FIG. 27. The tabs 235 may be frangibly connected to the cap key code device 233.

The collar portion 231 may include a lip 236 extending in an axial direction and a having cooperating structure 238 (such as the threads depicted) for securing the top member 224 to the collar portion 231. The lip 236 may be radially inset from the outer perimeter of the collar portion 231 to define a shoulder 240. An alignment structure 241 may project axially from the shoulder 240 and/or radially from the lip 236. The alignment structure 241 may include a recess 242 with a proximity switch material 243 disposed therein. The collar portion 231 may further include a skirt portion 244 having a ratchet structure 245 defined on an interior perimeter 245.1.

In operation, the cap handling loop 232 provides an alternative or an addition to the handling loops 228 from which containment vessel 104 may be handled when the cap assembly 234 is engaged. The cap handling loop 232 may be easier to form or fabricate than the handling loops 228 on the containment vessel 104. The ratchet structure 245 may cooperate with a mating structure (not depicted) on the containment vessel 104 to lock the cap assembly 234 in place and guard against loosening of the cap assembly 234.

The alignment structure 241 can provide an asymmetry that assures certain components such as the cap key code device 233 is coupled to the collar in the proper orientation for cooperation with dispensing heads. The cap key code device 233, in turn, may be configured to indicate a specific kind or class of liquids in the assembly such as photoresist, and/or to enable only certain dispensing heads to mate with the bottle (discussed later). Certain tabs 235 may be pried off, snapped off, clipped off or otherwise removed in accordance with the key code of the particular photoresist or other liquid that is contained in the bag-in-bag-in-bottle device 250. This way, a photoresist user and/or supplier does not have to stock several versions of a given configuration of cap key code device or make special molds for each. Instead, each cap key code device 233 may be considered universal and configurable for a specific photoresist code after manufacture with a simple tool such as a screw driver or an automated machine equipped to configure the key code device 233.

The embodiment depicted in FIG. 26 utilizes the captive gasket 206 in combination with the top member 224 that threadably engages with the cap assembly 234. The top member 224 may include recesses 246 for engagement with a spanner wrench, as depicted in FIGS. 26 and 27 for manipulation of the top member 224.

Figure 28:
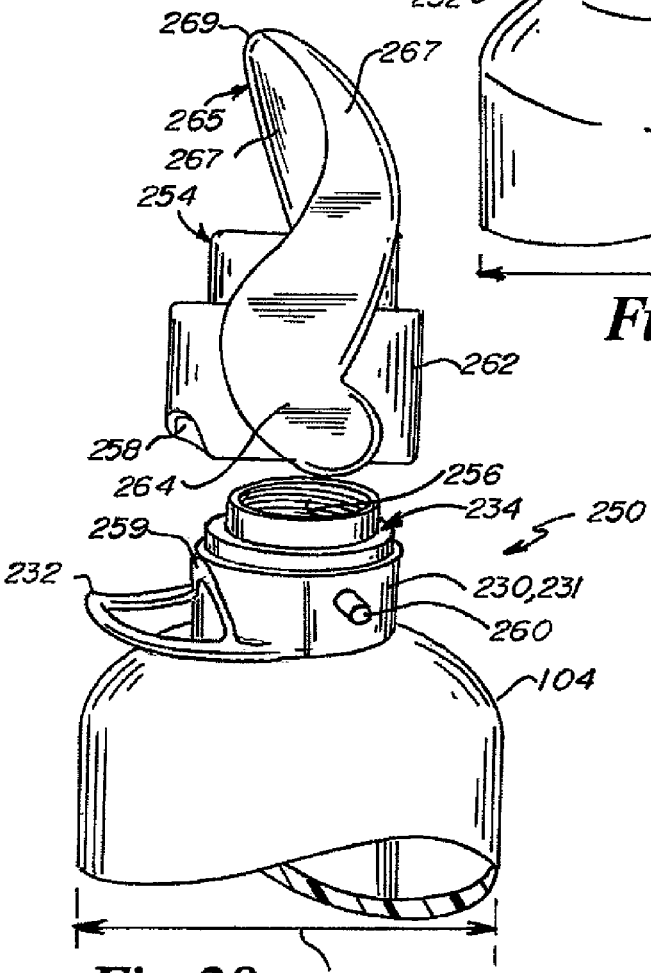

Referring to FIGS. 28 through 33, a bag-in-bag-in-bottle device 250 with the cap assembly 234 mounted thereto is depicted with a cam-actuated dispensing head 254 in an embodiment of the invention. The cap assembly 234 is depicted with the top member 224 removed to define an opening 256 (FIG. 28). The cam-actuated dispensing head 254 is operatively coupled with the cap assembly 234 and operatively coupled with the opening 256. The cam-actuated dispensing head 254 and the cap assembly 234 may include a gross alignment structure such as a V-notch 258 on one side of the dispensing head 254 that cooperates with a V-ridge 259 on one side of the cap body 230 of the cap assembly 234. The cap assembly 234 may also include diametrically opposed pins 260 that project radially from the periphery of the cap body 230 or collar portion 231. To assemble, the cam-actuated dispensing head 254 is placed over the open cap assembly 234 so that a dip tube portion 270 extends through the opening 256 and into the inner dispensing fitment 110. Typical and non-limiting dimensions of the bag-in-bag-in-bottle device 250 depicted herein is approximately 18-cm diameter and 30-cm height and has a capacity of approximately 4-liters. Typical size ranges, again non-limiting, may range from approximately 9- to 30-cm diameter and approximately 27- to 76-cm height with capacities ranging from approximately 1- to 20-liters.

The cam-actuated dispensing head 254 may include a body 262 with a pair of pivot members 263 that support a rotatable actuator handle 265. The body 262 may include side slots 261 to accommodate the pins 260 that extend from the cap body 230 of the cap assembly 234. The rotatable actuator handle 265 may include a pair of cam members 264 operatively coupled with the pivot members 263. Each of the cam members 264 may comprise arcuate slots 268 that slidingly engage the pins 260. An arm member 267 may extend from each of the cam members 264. The arm members 267 may be of a curved shape and may be joined at a distal end 269 to form a handle 266 resembling a contoured U-shape or a V-shape that straddles the body 262. Some or all of the components of the handle 266 (i.e. the cam members 264, the arm members 267 and the distal end 269) may be integrally formed.

Figure 30:
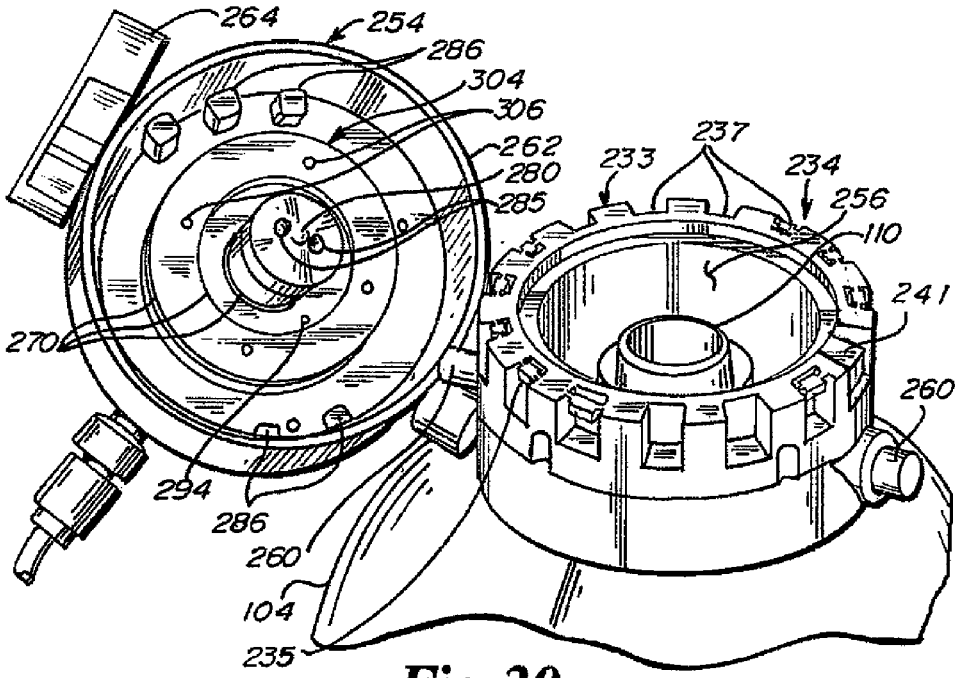
FIG. 30 is partial perspective view of the bag-in-bag-in-bottle assembly of FIG. 29 with the cam-actuated dispensing head removed.

The cam-actuated dispensing head 254 may include the dip tube portion 270 that depends from a top portion 272 of the body 262, through the inner dispensing fitment 110 and into the inner flexible container 114. The dip tube portion 270 may include one or more flow passages 275 that extend axially through the dip tube portion 270 and establish fluid communication between the contents of the inner flexible container 114 and a resist outlet 290 (FIG. 30). In one embodiment, the cam-actuated dispensing head 254 may include an extended dip tube 280. The extended dip tube may include an external passage 282 such as a spiral groove formed on the exterior.

In operation, the external passage 282 can prevent pockets of fluid from being trapped against the dip tube portion 280 (FIG. 33). For example, as the inner flexible container 114 approaches emptiness, the pressure of the inner flexible container 114 against the dip tube portion 280 sans the external passage 282 can suspend a pocket of liquid so that it cannot flow directly downward and accumulate at the inlet to the flow passage 275. The external passage 282 provides a flow passage down because the inner flexible container 114 does not seal off the external passage 282, thus enabling the liquid to flow downward for entry into the flow passage 275.

Figure 31:
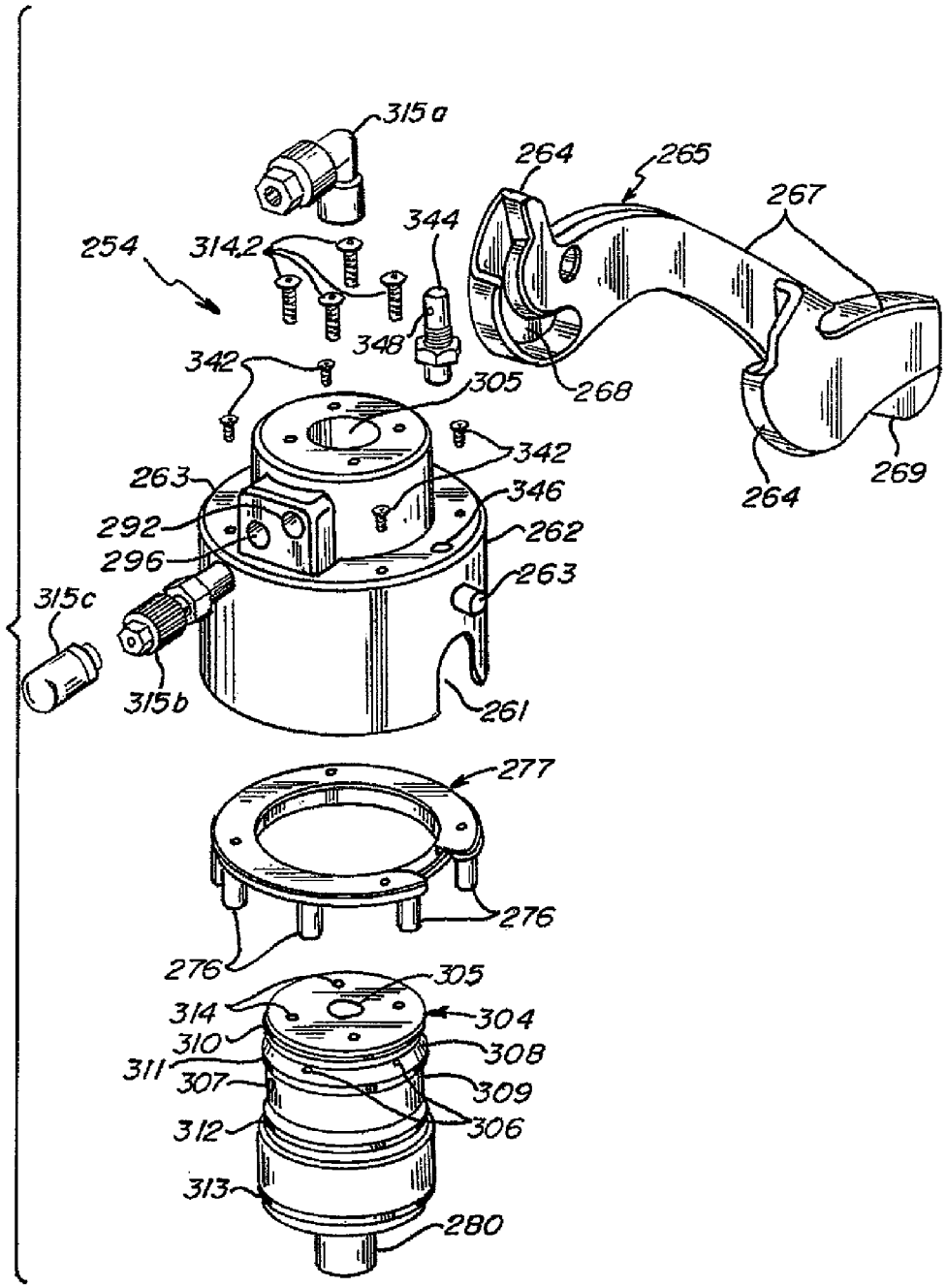
FIG. 31 is an exploded view of the profiled cam-actuated dispensing head of FIG. 30.

A plurality of male key code protrusions 276 may depend from a dispense head key code device 277 disposed in the body 262 (FIG. 31). The male key code protrusions 276 may be configured to register within corresponding female key code slots 237 on the cap key code device 233. The dispense head key code device 277 may be coupled to the body 262 with fasteners 279 (as depicted), by gluing, welding or by other ways available to the artisan.

Functionally, the key code protrusions 276 and the cap key code device 233 may be configured to mate only with each other or with certain subsets of photoresist bottles. This prevents against inadvertently connecting the wrong type of photoresist to a cap that is designated by the cap key code device 233 to receive only a specific or compatible type of photoresist. Some bottles may be universally applied to any cap (e.g., cap assembly 234) by exposing all key code slots 237.

The preceding depictions and descriptions are directed to key code devices 233 and 277 that comprise a ring-shaped body. Other geometries for the bodies of the key code devices 233 and 277 may be utilized, such as, but not limited to, a disc, a polygon or a frame. Furthermore, while the depicted embodiments depict the cap key code device 233 as having slots and the dispense head key code device 277 as having protrusions, the opposite arrangement may be utilized. That is, the slotted structure may be located in the dispense head and the protrusion structure may be part of the cap assembly.

In one embodiment, inlet passages 306 on the cam-actuated dispensing head 254 are in fluid communication with an inlet port 292 to enable pressurization of the outer flexible container 118 of FIG. 21. The dispensing head 254 may also include a venting passage 307 in fluid communication with a vent port 296 for venting air or gas trapped between the inner flexible container 114 and the outer flexible container 118.

Figure 32A:
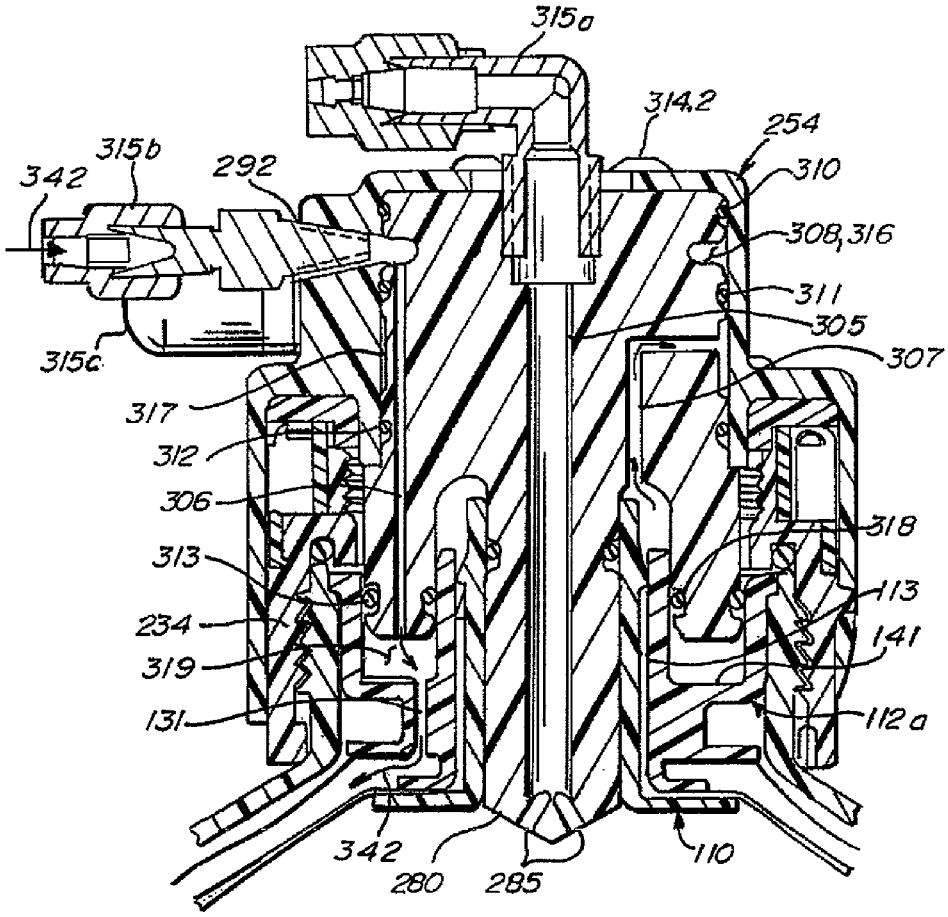
FIG. 32A is a partial sectional view of the cam-actuated dispensing head in assembly with the bag-in-bag-in-bottle device of FIG. 30.

The cam-actuated dispensing head 254 may include a routing plug 304*a* for the routing of photoresist, pressure gas and venting gas in an embodiment of the invention. The routing plug 304*a*, presented in isolation in the exploded view of FIG. 31 and in assembly in the cam-actuated dispensing head 254 of FIG. 32A, is configured to mate with the single-piece outer fitting 112 of FIG. 3A. The routing plug 304*a* may include a central passage 305 that extends axially into the dip tube portion 270. In one embodiment, a plurality of supply passages 306 are in fluid communication with the pressurization supply passageways 131 of the outer fitment 112 to enable pressurization of the outer flexible container 118 of FIG. 21. A venting passage 307 may be formed in the routing plug 304*a* that is in fluid communication with the annular venting passage 113 defined between the inner and outer fitments 110 and 112. The routing plug 304*a* may also include a supply channel 308 and a venting channel 309 formed on the outer periphery of the routing plug 304*a*, and a plurality of outer periphery o-rings 310 through 313. The routing plug may also include tapped holes 314 for mounting to the body 262 of the cam-actuated dispensing head 254 with fasteners 314.2.

An alternative routing plug 304*b* may be implemented when the two-piece outer fitment 112*b* of FIG. 3B is utilized. The continuous annular channel 141 of the two-piece outer fitment 112*b* may not be sealed because of the interface between the bridging structure 138 and the central portion 129 and the flexure slots 139.4. Accordingly, the inlet ports 132 of the two-piece outer fitment 112*b* are routed inside the central portion 129, so that the pressurization fluid 342 bypassing the continuous annular channel 141. Note that this arrangement eliminates the need for the o-ring 313 of the FIG. 32A configuration and that o-ring 318 prevents gas from entering, not leaving, the continuous annular channel 141.

In assembly, a first fitting 315*a* may be coupled with the central passage 305 for dispensing photoresist therethrough. The outer periphery o-rings 310 and 311 can seal against the interior of the body 262 to provide a first tangential passageway 316 in communication with a second fitting 315*b*. Likewise, the outer periphery o-rings 311 and 312 can seal against the interior of the body 262 to provide a second tangential passageway 317 that is in fluid communication with the venting passage 307 and a filter 315*c*. The outer periphery o-ring 313, in combination with an interior o-ring 318, can seal with the continuous annular channel 141 to define a third tangential passageway 319 in fluid communication with the pressurization supply passageways 131 and the supply passages 306.

In operation, the pressurization fluid 342 such as nitrogen gas is supplied to the second fitting 316 and is passed through the first tangential passageway 316, supply passages 306 and the third tangential passageway 319, entering the supply passageways 131 and causing photoresist to exit the bag-in-bag-in-bottle device 250 through the first fitting 314 by the mechanism previously discussed. Vented gas that exits the assembly via the annular venting passage 113 is passed through the venting passage 307, into the second tangential passageway 317, and exits through the filter 315*c*.

The filter 315*c* may be comprised of a selectively permeable material such as GORTEX that enables passage of gases while serving as a barrier to liquids. This way, should photoresist find its way to the filter 315*c*, it would still be prevented from leaking outside the bag-in-bag-in bottle device 250.

A proximity switch 344 (FIG. 31) may also be coupled with the body 262 at a port 346 that is substantially aligned with the proximity material 243 (FIG. 26) of the cap assembly 234. The proximity switch may be a capacitance sensor that is activated when in the proximity of the proximity material 243. The proximity material 243 may be of a suitable material such as metal.

In operation, the proximity switch 344 is brought near the proximity material 243 when the dispensing head 254 approaches the fully engaged position, and can be adjusted so that the proximity switch 344 closes accordingly. The proximity switch 344 may include a light 348 that illuminates either when the switch 344 is open or, alternatively, when the switch 344 is closed.

Figure 34B:
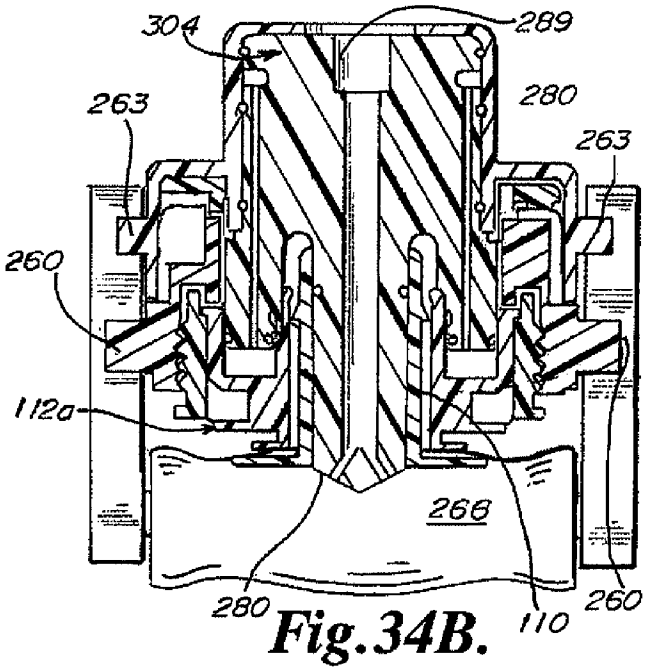
FIGS. 34A and 34B are sectional views of a cam-actuated dispensing head at the fully disengaged and the fully engaged stages of actuation, respectively, in an embodiment of the invention.
Figure 34A:
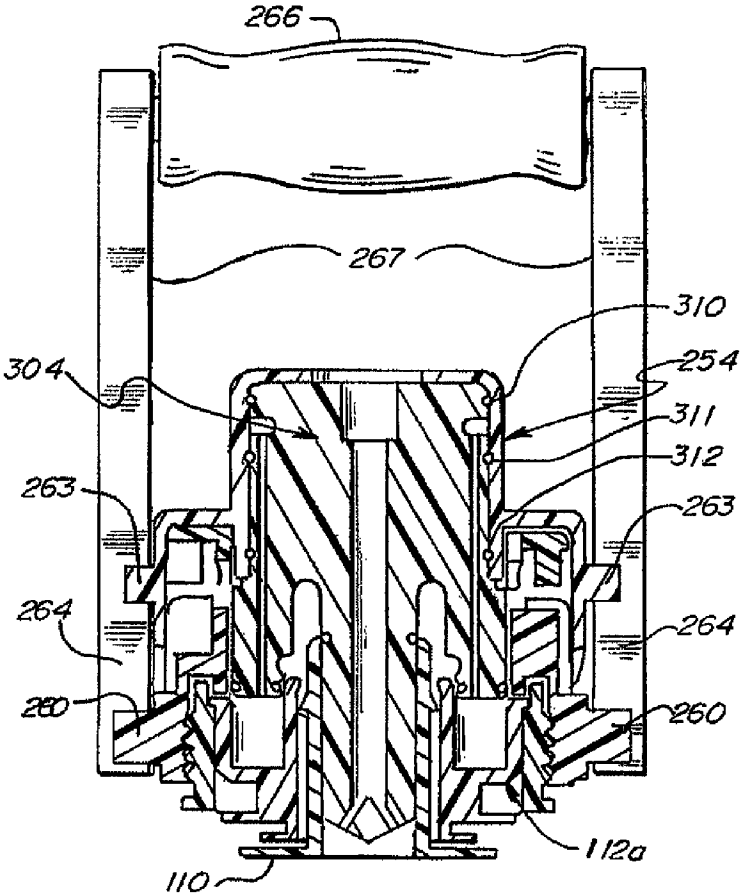
Figure 35:
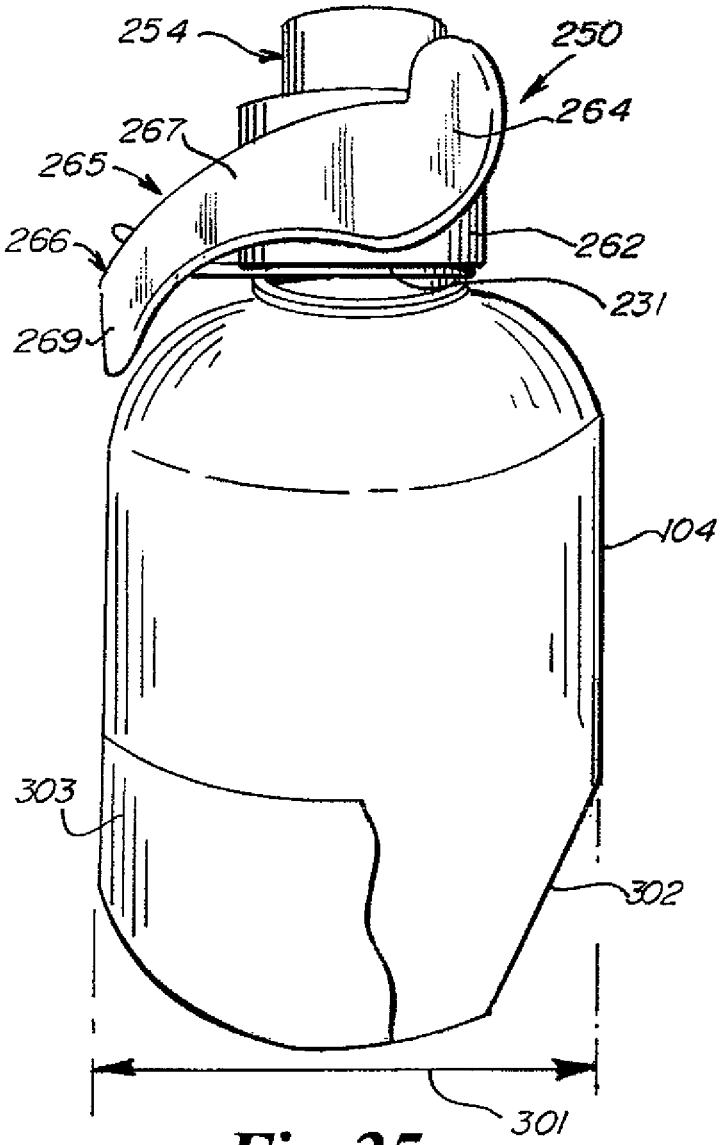
FIG. 35 is an elevational view of a bag-in-bag-in-bottle assembly of FIG. 29 in a fully engaged position.

Referring to FIGS. 34A and 34B, the operation of the cam-actuated dispensing head 254 is depicted in an embodiment of the invention. When the handle 266 is motivated from a first position (e.g., in the upward position as depicted in FIG. 34A) to a second position (e.g., the downward position as depicted in FIG. 35), the various o-rings 310-313, 318 are slidingly and/or compressively engaged between the dispensing head 254 and the cap assembly 234 to effect a seal therebetween. The V-notch and V-ridge mating structures 258 and 259 may be utilized to assure the cam-actuated dispensing head 254 and the cap assembly 234 are engaged in a proper orientation with respect to each other. The arm members 267 can provide substantial leverage for coupling and de-coupling the dispensing head 254 with the cap assembly 234. Note also that FIGS. 34A and B depict the arm members 267 as being planar and the handle 266 as being perpendicular to the arm members 267, in an alternative embodiment to the contoured U- or V-shaped handle 266 configurations of FIGS. 28 through 33.

Figure 36:
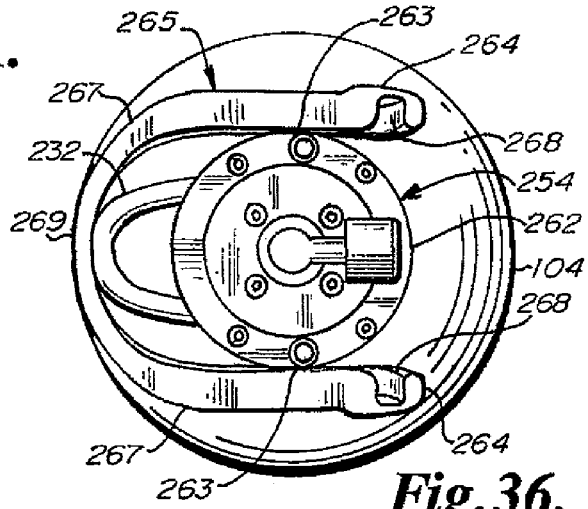
FIG. 36 is a top view of the bag-in-bag-in-bottle assembly of FIG. 29.

Referring to FIGS. 35 and 36, the profiled aspects of the cam-actuated dispensing head 254 is depicted in an embodiment of the invention. The containment vessel 104 may be characterized as having an overall diameter or footprint 301. The rotatable actuator handle 265 may be shaped and dimensioned so that the distal end 269 or any other portion does not extend beyond the footprint 301 of the containment vessel 104 when the cam-actuated dispensing head 254 is fully engaged.

The containment vessel 104 may also be shaped to accommodate the shape of the bag-in-bag assembly, such as by having tapered sides 302 near the bottom of containment vessel 104 (FIG. 35). A boot 303 may be provided on the bottom of such a container to provide stability.

Functionally, the long swing radius of the rotatable actuator handle 265 about the pivot members 263 can have a preventative effect to prevent the handle from being raised when in a confined location (e.g., a receiving region for related process equipment or when positioned adjacent other bag-in-bag-in bottle devices). The confinement prevents the arm members 267 from fully extending in the horizontal direction. Operating facilities may further be designed with designated areas to capitalize on this aspect, where spent bottles are exchanged with full bottles, thereby providing added operational safety.

As an added measure of safety, the rotatable actuator handle 265 may provide a visual indication that the dispensing head 254 is not in a fully engaged position whenever the arm members 267 are not in a sloping downward position.

Furthermore, profiled aspect of the cam-actuated dispensing head 254 may be less susceptible to accidental release during handling than the rotatable actuator assembly 265. When the containment vessel is stored amongst other devices such as other bag-in-bag-in-bottle devices having cam-actuated dispensing heads with attendant arm members 267, the likelihood that the arm members 267 will catch with the neighboring device when either is removed from storage is less likely than for configurations where the arm members extend beyond the footprint 301 of the containment vessel 104 or boot 303. The same is true for storage proximate a wall or corner; there is less likelihood of accidental release of the cam-actuated dispensing head 254 due to rubbing or collision with the wall or corner when the rotatable actuator assembly is within the footprint 301 of the containment vessel 104 in the fully engaged position.

Moreover, the cap handling loop 232 that extends from the collar 231 may be positioned so that it is framed or partially surrounded by and in close proximity with the handle 266 when the cam-actuated dispensing head 254 is fully engaged. Such an arrangement enables the rotatable actuator handle 265 to be secured to the cap handling loop 321 with devices such as a padlock, cable tie, clip, tether, wire or other fastening device. Also, personnel handling the containment vessel 104 with the cam-actuated dispensing head 254 may be instructed to or otherwise tend to grasp both the rotatable actuator handle 265 and the cap handling loop 321 simultaneously. The grasping of the loop may prevent the handle from being accidentally released during handling.

Referring to FIGS. 37 and 37A through 37C, a dispensing head 350 having a snap lock handle 352 is depicted in an embodiment of the invention. The snap lock handle 352 may include an arcuate groove 354 with dimples or sockets 356 therein, and may also include a pair of sockets 358 that cooperates with the pivot members 323 to support the handle. A detent 360 may protrude from the body 262 of the dispensing head 350. In the depicted embodiment, there are two such grooves 354 and detents 360. The detent 360 may be formed integrally with the body 262 and may include a hemispherical tip, as depicted in FIG. 38A. Other structures, such as a spring loaded ball plunger, may be utilized as alternatives to the detent 360.

Figure 37A:
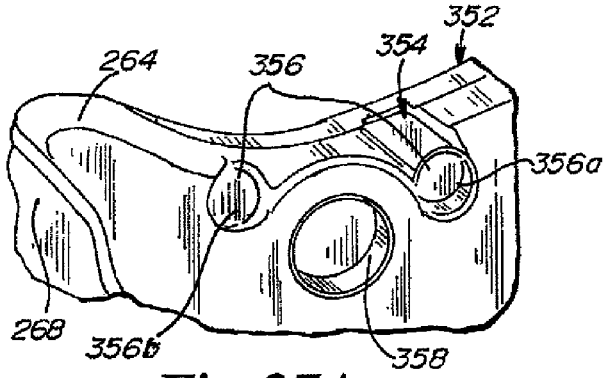
FIG. 37A is an enlarged partial view of the groove and socket structure of the snap lock handle of FIG. 37.
Figure 37B:
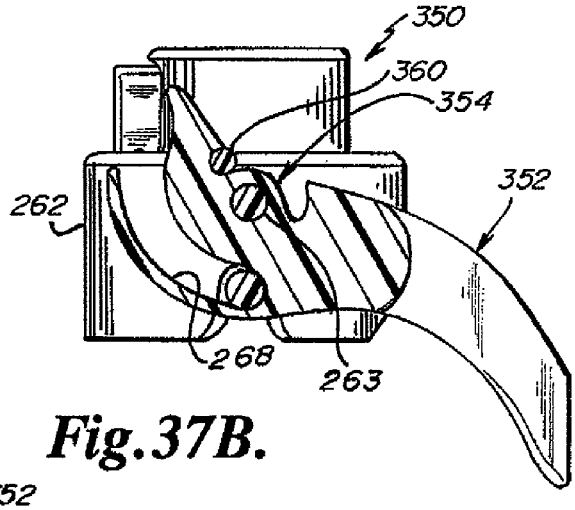
FIGS. 37B and 37C are partial cutaway elevation views of the dispensing head of FIG. 37 in the fully engaged and the fully disengaged positions, respectively.

In operation, the elasticity or resiliency of the snap lock handle 352 may hold the sockets 358 on the pivot members 323. When the dispensing head 350 is in the fully disengaged position (FIG. 37C), the detent 360 is aligned with a first socket 356*a* of the sockets 356 (FIG. 37A). The elasticity of the snap lock handle 352 may also hold the first socket 356*a* in engagement with the detent 360 to maintain the snap lock handle 352 in a substantially upright position. The detent 360 and/or the first socket 356*a* may be configured so that the detent 360 can slide out of the first socket 356*a* by exerting an actuation force 370 on the snap lock handle 352 that causes a moment about pivot members 323. The hemispherical tip of the detents 360 depicted in FIG. 37A may be suitable for this purpose. The detent 360 and the first socket 356*a* may be configured so that the actuation force 370 required to cause the disengagement may be readily exerted by operating personnel.

Figure 37C:
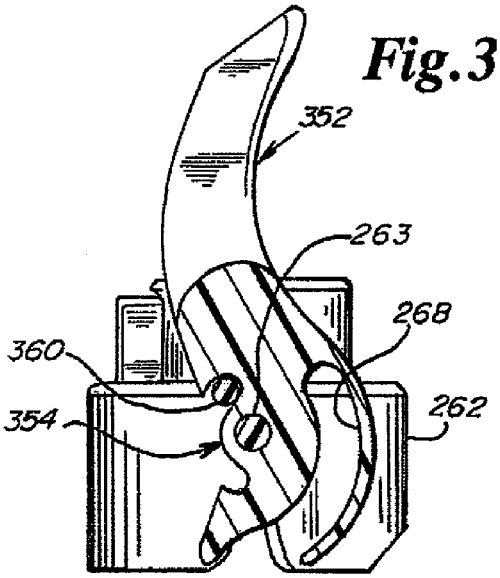

A second socket 356*b* of the sockets 356 (FIG. 37B) may be of similar construction to the first socket 356*a*, and may be positioned within the arcuate groove 354 to engage the detent when the dispensing head 350 is in the fully engaged position (FIG. 37C). The detent 360 may be dislodged from the second socket 356*b* by exerting a force that is in a substantially opposite direction as the actuation force 370.

When the snap lock handle 352 is oriented so that the detent 360 is inbetween the sockets 356, the snap lock handle 352 may be radially flexed outward relative to the fully engaged or fully disengaged position. The displacement may be enough to enable the detent 360 to slide along the arcuate groove 354 while not being enough to cause the sockets 358 to slide off the ends of the pivot members 323.

Functionally, when the detent 360 is engaged in one of the sockets 356, the snap lock handle 352 is affirmatively held in the respective position (e.g. fully engaged or fully disengaged), which may prevent the dispensing head 350 from being spuriously engaged or disengaged. When the handle is brought into one of these positions from an intermediate position, the snap lock handle 352 may "snap" onto the detent 360, causing a sound and/or feel that notifies the operator that the handle has reached the respective position.

Note that the patents included by reference herein and identified in the Background of the Invention are also hereby deemed to be included in the Detailed Description for the purpose of disclosing components, materials, processes, configurations that are consistent with, or compatible with, and/or that can be utilized with the specific embodiments disclosed herein.

References to relative terms such as upper and lower, front and back, left and right, or the like, are intended for convenience of description and are not contemplated to limit the present invention, or its components, to any specific orientation. All dimensions depicted in the figures may vary with a potential design and the intended use of a specific embodiment of this invention without departing from the scope thereof.

Each of the figures and methods disclosed herein may be used separately, or in conjunction with other features and methods, to provide improved systems and methods for making and using the same. Therefore, combinations of features and methods disclosed herein may not be necessary to practice the invention in its broadest sense and are instead disclosed merely to particularly describe representative embodiments of the invention.

It is to be understood that the invention may be embodied in other specific and unmentioned forms, apparent to the skilled artisan, that do not depart from the spirit or essential attributes of the invention. Therefore, the foregoing embodiments are in all respects illustrative and not to be construed as limiting. Rather, the invention is defined by the attached claims and their legal equivalents.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A dispensing system for dispensing a liquid, comprising:

a dispense bag for containing said liquid and including a sheet of flexible material having an exterior surface;

a pressurization bag substantially surrounding said dispense bag, said pressurization bag including a flexible inner portion and a flexible outer portion that cooperate to at least partially define an interior cavity therebetween, said flexible inner portion having an exterior surface exterior to said interior cavity and being in physical contact with said exterior surface of said sheet of flexible material of said dispense bag, said physical contact being on opposing sides of said dispense bag;

a containment vessel having an inner surface that defines an interior chamber, said dispense bag and said pressurization bag being disposed within said interior chamber, said outer portion of said pressurization bag being confined by said inner surface of said containment vessel;

a first fitment operably coupled with said dispense bag and adapted to route said liquid to or from said dispense bag; and a second fitment operably coupled with said pressurization bag and adapted to route a fluid to or from said pressurization bag, wherein said first fitment and said second fitment cooperate as a fitment assembly, said fitment assembly adapted to vent gas from said interior chamber of said containment vessel.

2. The dispensing system of claim 1 wherein said fluid is a gas.

3. The dispensing system of claim 1 wherein said containment vessel is a rigid structure.

4. The dispensing system of claim 1 wherein said dispense bag comprises perfluoroalkoxy.

5. The dispensing system of claim 1 wherein said pressurization bag comprises polyethylene.

6. A dispensing system for dispensing photo resist, the system comprising:

a first flexible bag comprising a polymer for containing said photo resist, said first flexible bag having an outer surface;

a second flexible bag comprising a polymer adjacent said first flexible bag, said second flexible bag defining a pressurization chamber, said second flexible bag being in contact with said outer surface of said first flexible bag to define an interface therebetween; and a containment vessel having an inner surface that defines an interior chamber, said first and second flexible bags being disposed within said interior chamber;

a fitment attached to the containment vessel and having connections to the first bag and second bag, said fitment including a venting passage in fluid communication with the exterior of the first bag, the exterior of the second bag and said interface between said first flexible bag and said second flexible bag.

7. A dispensing system for dispensing a liquid, comprising:

a dispense bag defining an inner chamber for containing said liquid, said dispense bag including an exterior surface;

a pressurization bag that defines a pressurization chamber bounded at least by an inner member and an outer member, said pressurization bag having a first portion and a second portion, said dispense bag being disposed between said first and second portions such that said inner member of said first and second portions of said pressurization bag contact opposing sides of said outer surface of said dispense bag;

a containment vessel having an inner surface that defines a containment chamber, said dispense bag and said pressurization bag being disposed within said containment chamber, said outer portion of said pressurization bag being confined by said containment vessel;

an outer fitment in fluid communication with said pressurization chamber of said pressurization bag; and an inner fitment in fluid communication with said inner chamber of said dispense bag.

8. The dispensing system of claim 7, wherein an edge portion of said dispense bag is attached to an edge portion of said first portion of said pressurization bag and to an edge portion of said second portion of said pressurization bag.

9. The dispensing system of claim 7, wherein:

said dispense bag includes a first sheet material comprising polytetrafluoroethylene, said sheet material having a thickness less than 0.25 millimeters;

said pressurization bag is less permeable to gases than said polytetrafluoroethylene, said inner member and said outer member of said pressurization bag each having a thickness less than 0.25 millimeters.

10. The dispensing system of claim 7, wherein said inner fitment is disposed within said outer fitment.

11. The dispensing system of claim 10, wherein said outer fitment is a two-piece fitment.

12. The dispensing system of claim 11 wherein said outer fitment includes a distal portion and a base portion, said distal portion being configured to snap over said base portion.

13. A dispensing system for dispensing a liquid, the system comprising:

a first flexible bag comprising a polymer and defining a containment chamber for containing said liquid, said first flexible bag having an outer surface;

a second flexible bag comprising a polymer adjacent said first flexible bag, said second flexible bag defining a pressurization chamber, said second flexible bag being in contact with said outer surface of said first flexible bag to define an interface therebetween; and a fitment assembly having connections to the first bag and second bag, said fitment assembly including a venting passage in fluid communication with the exterior of the first bag, the exterior of the second bag and said interface between said first flexible bag and said second flexible bag.

14. The dispensing system of claim 13, wherein:

said first flexible bag includes an attaching tab that includes structure defining a through hole;

said second flexible bag includes a seam allowance, said seam allowance including a first portion that is disposed on a first side of said through hole, said seam allowance including a second portion that is disposed on a second side of said through hole, said first portion of said seam allowance being attached to said second portion of said seam allowance through said through hole.

15. The dispensing system of claim 13 wherein said second flexible bag comprises polyethylene.

16. The dispensing system of claim 13, wherein said first flexible bag includes a first sheet material comprising polytetrafluoroethylene, said first sheet material having a thickness less than 0.25 millimeters.

17. The dispensing system of claim 13 wherein said first flexible bag comprises one of perfluoroalkoxy and polytetrafluoroethylene.

18. The dispensing system of claim 13, wherein said liquid is a photo resist.

19. The dispensing system of claim 13, further comprising a containment vessel having an inner surface that defines an interior chamber, said first flexible bag and said second flexible bag being disposed within said interior chamber.

20. The dispensing system of claim 19 wherein said containment vessel is a rigid structure.

21. The dispensing system of claim 19, wherein said fitment assembly is attached to said containment vessel.

22. The dispensing system of claim 13, wherein said fitment assembly includes:

an inner fitment in fluid communication with said containment chamber of said first flexible bag; and an outer fitment in fluid communication with said pressurization chamber of said second flexible bag.

23. The dispensing system of claim 22, wherein said inner fitment is disposed within said outer fitment.

24. The dispensing system of claim 22, wherein said outer fitment is a two-piece fitment.

25. The dispensing system of claim 24 wherein said outer fitment includes a distal portion and a base portion, said distal portion being configured to snap over said base portion.

* * * * *

UNITED STATES PATENT AND TRADEMARK OFFICE

CERTIFICATE OF CORRECTION

PATENT NO. : 8,844,774 B2
APPLICATION NO. : 12/200590
DATED : September 30, 2014
INVENTOR(S) : Leys et al.

It is certified that error appears in the above-identified patent and that said Letters Patent is hereby corrected as shown below:

On Title Page, Column 1, in item (51), under "Int. Cl.",
delete "*B65D 83/00* (2006.01)
*B67D 7/60* (2010.01)
*B67D 1/08* (2006.01)" and
insert -- *B65D 83/00* (2006.01)
*B67D 7/60* (2010.01) --, therefor.

On Title Page, Column 2, in item (57), under "ABSTRACT", Line 12, delete "earn" and insert -- cam --, therefor.

In the Claims

In Column 21, Claim 2, Line 55, delete "claim 1 wherein" and insert -- claim 1, wherein --, therefor.

In Column 21, Claim 3, Line 57, delete "claim 1 wherein" and insert -- claim 1, wherein --, therefor.

In Column 21, Claim 4, Line 59, delete "claim 1 wherein" and insert -- claim 1, wherein --, therefor.

In Column 21, Claim 5, Line 61, delete "claim 1 wherein" and insert -- claim 1, wherein --, therefor.

In Column 22, Claim 12, Line 52, delete "claim 11 wherein" and insert -- claim 11, wherein --, therefor.

In Column 23, Claim 15, Line 13, delete "claim 13 wherein" and insert -- claim 13, wherein --, therefor.

In Column 23, Claim 17, Line 19, delete "claim 13 wherein" and insert -- claim 13, wherein --, therefor.

Signed and Sealed this
Second Day of June, 2015

Michelle K. Lee

Michelle K. Lee
*Director of the United States Patent and Trademark Office*

In Column 24, Claim 20, Line 5, delete “claim 19 wherein” and insert -- claim 19, wherein --, therefor.

In Column 24, Claim 25, Line 20, delete “claim 24 wherein” and insert -- claim 24, wherein --, therefor.